United States Patent [19]

Bittar

[11] 4,401,190

[45] Aug. 30, 1983

[54] CARS/FLOORS AND CALLS/CARS ELEVATOR ASSIGNMENTS

[75] Inventor: Joseph Bittar, Simsbury, Conn.

[73] Assignee: Otis Elevator Company, Farmington, Conn.

[21] Appl. No.: 308,745

[22] Filed: Oct. 2, 1981

Related U.S. Application Data

[63] Continuation of Ser. No. 99,396, Dec. 3, 1979, abandoned.

[51] Int. Cl.[3] ..... B66B 1/20

[52] U.S. Cl. ..... 187/29 R

[58] Field of Search ..... 187/29

[56] References Cited

U.S. PATENT DOCUMENTS 4,037,688 7/1977 Winkler ..... 187/29

*Primary Examiner*—J. V. Truhe
*Assistant Examiner*—W. E. Duncanson, Jr.
*Attorney, Agent, or Firm*—M. P. Williams

[57] ABSTRACT

An elevator system employs a microprocessor-based group controller to control the service of a group of elevator cars to a plurality of floor landings in a building. The group controller includes zone-control type operation, including up peak traffic handling, down peak traffic handling, and distributing of cars around the building during periods of low traffic or no demand, when in a cars-to-floors mode of operation. The group controller can assign any unanswered call to any car in the builing, in dependence upon factors relating the desirability of assigning any call to a car, in a calls-to-cars mode of operation. The group controller is in the cars-to-floors mode of operation whenever there is up peak traffic conditions, down peak traffic conditions, or no registered hall calls, provided that the cars-to-floors mode of operation cannot be entered into as a consequence of no registered hall call until at least one car is located at the lobby. In the event there is no lobby car, or no car call or hall call forcing a car to the lobby, a lobby call is forced and the calls-to-cars mode of operation is continued until a car becomes located at the lobby. Exemplary elevator apparatus including a microprocessor-based group controller, as well as computer program logic flow diagrams illustrative of an overall group controller program, as an environment for the present invention, and illustrative of detailed implementation of an exemplary embodiment of the invention, are disclosed.

2 Claims, 20 Drawing Figures

CARS/FLOORS AND CALLS/CARS ELEVATOR ASSIGNMENTS

This is a continuation of application Ser. No. 099,396 filed on Dec. 3, 1979, now abandoned.

DESCRIPTION

TECHNICAL FIELD

This invention relates to elevator systems of the type having a plurality of cars servicing the landings of a building in response to a group control, and more particularly to diverse modes of operation of the group controller in providing control of the cars in servicing the building.

BACKGROUND ART

Sophisticated elevator systems of the type in which a plurality of cars serve a plurality of floors of a building in response to a group controller generally comprise one of two diverse types. A first type of elevator system is zone-controlled: the building is divided into a plurality of zones, each zone having one or a number of floors in it, there being approximately the same number of zones as there are elevator cars serving the building. The group controller recognizes zones having no cars in them and forces cars into the zones, and hall calls within the zones are normally to be handled by the car located within the zones. Such systems have a drawback in that once a car commences servicing calls within its zone, calls in the opposite direction or calls behind the travel of the car are no longer serviceable by it. Therefore, backup modes and optional features are generally provided to call cars from other zones to assist a zone in which the calls are not capable of being responded to in a desirable fashion, or to fill a preferred zone at the expense of a less preferred zone when there is no car available and unassigned which can be forced to the zone. In addition, once any zone requires additional cars assigned to it to assist in handling the service demand in that zone, backup modes of operation are employed, which cause failure of the system to adequately handle other zones in the building. In such case, even a further degree of backup mode is frequently required so as to unequivocally command a car, which may be needed elsewhere, to answer a hall call which has been outstanding for an unacceptably long time.

Such zone-controlled systems also require additional features or modes of operation in order to ensure, in the event that one of the cars normally available for assignment to a zone is out of service, that among the zones which are serviced, the lobby or other main landing is included.

To overcome certain of the difficulties of zone-controlled systems, other systems employ methods of assigning calls to cars, such as by calculation of the amount of time it is estimated for a car to reach a floor landing at which a call is outstanding, taking into account the service which must be performed by the elevator between its present position and reaching the floor landing for the call under consideration. Heretofore, systems of the prior art have allocated the calls to the cars based upon conditions which exist at the time each hall call is first assigned to a car, the assignment in most cases being unequivocal, unless the call remains unanswered after a predetermined, unacceptable period of time. In such cases, the hall call is frequently treated as a new call and a new assignment is found for it. In other cases, the hall call is reconsidered for assignment to other cars, but the comparison made between reconsidered assignments and the original assignment is based upon the factors which control the original assignment, rather than current factors for the original car.

In both of these types of systems, consideration has previously been given to the alignment of a car with a call, without much consideration being given to other system needs, expected future service, and the like.

The shortcomings of the zone-controlled and the call assignment systems known to the prior art have recently been overcome by inventions disclosed and claimed in commonly owned copending U.S. patent applications filed on even date herewith by Bittar, Ser. No. 099,790 and Ser. No. 099,945. By employing the inventions in both of said copending applications, a system which assigns calls to cars, based upon system response factors in addition to the delay of a given car in reaching the floor landing at which the hall call to be assigned is located, on a cyclic basis which recurs several times per second, continuously assigning each unanswered hall call to any car available for group control in the answering of hall calls, eliminates the difficulties of providing hall call answering service by a plurality of elevators in a building. However, an additional drawback of an elevator system of the type that assigns calls to cars is that the cars are not distributed evenly throughout the building during periods of no demand or low demand, and therefore the ability of such a system to respond to calls following periods of low demand, particularly buildings having a large number of floors, is diminished. In addition, such systems do not adequately accommodate excessive demand for service at a main landing, such as a lobby, during periods of up peak traffic, such as the start of a normal working day. Further, the ability to provide a special type of service during down peak traffic, in which the upper floors are favored to receive unassigned cars, but service is maintained throughout the building (being less severe than up peak traffic in most cases) is lacking in prior art systems which assign calls to cars.

DISCLOSURE OF INVENTION

Objects of the invention include provision of the best features of elevator systems which assign calls to cars during normal traffic conditions, but which maintain the advantageous features of zone-control systems, such as in handling up peak and down peak traffic and in distributing cars throughout the building during periods of low traffic or no traffic.

According to the present invention, an elevator control system is provided with a cars-to-floors mode of operation and with a calls-to-cars mode of operation, the cars-to-floors mode being selected in dependence on there being up peak or down peak traffic conditions or no hall calls to be answered, and otherwise the calls-to-cars mode is selected. In the cars-to-floors mode of operation, zone-control over the cars is effected by the group controller. In the calls-to-cars mode of operation, each unanswered call is assigned to any of the available cars in the building, as is deemed best suited to respond to the call in accordance with a scheme of system response.

In further accord with the present invention, the selection of the cars-to-floors mode of operation in response to no traffic demand, as indicated by a lack of hall calls, is inhibited until there is a car located at the main landing (and/or other preferred floor) of the building; failure of there being a car located at the main landing of the building, or a car call or hall call forcing a car to the main landing of the building, will force such a call and retain the calls-to-cars mode of operation to ensure that a car arrives at the lobby floor before the cars-to-floors mode of operation is invoked for distributing the remaining cars among the zones of the building.

The present invention provides the advantages of two sophisticated types of systems, without the disadvantages of either. The invention further provides for assurance that a preferred landing, such as the main or lobby landing of a building, will be capable of providing rapid service by requiring that the distribution of cars throughout the building during periods of no traffic will be accommodated with at least one car assigned to the lobby. The invention may be implemented in a wide variety of elevator systems known to the prior art, utilizing readily available technology, in the light of the teachings of the invention as described hereinafter.

The foregoing and other objects, features and advantages of the present invention will become more apparent in the light of the following detailed description of an exemplary embodiment thereof, as illustrated in the accompanying drawings.

BEST MODE FOR CARRYING OUT THE INVENTION

Figure 1:
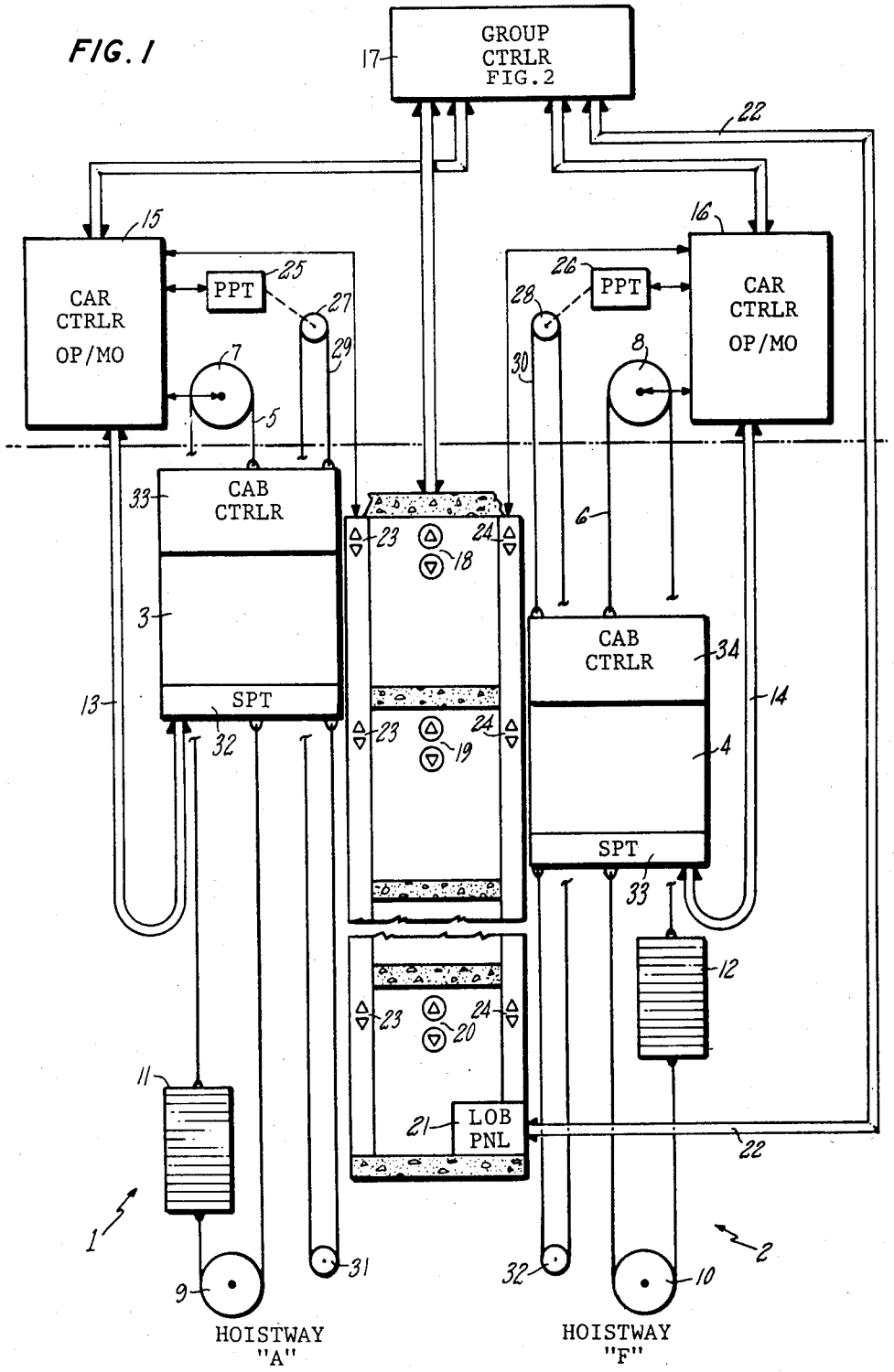
FIG. 1 is a simplified, schematic block diagram, partially broken away, of an elevator system in which the present invention may be incorporated.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven either direction or held in a fixed position by a drive sheave/-motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissable load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself are directed, or communicated with, by means of a cab controller 33, 34 in accordance with the present invention, and may provide serial, time-multiplexed communications with the car controller as well as direct, hard-wired communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor. The cab controller interfaces with load weighing transducers to provide weight information used in controlling the motion, operation, and door functions of the car. The load weighing may be in accordance with the invention described and claimed in commonly owned copending patent applications filed on Nov. 27, 1979, by Donofrio, Ser. No. 098,003 and by Games, Ser. No. 098,003. A most significant job of the cab controller 33, 34 is to control the opening and closing of the door, in accordance with demands therefore under conditions which are determined to be safe.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977-1978 Second Edition, published by Digital Equipment Corporation, Maynard, Mass., U.S.A. And, Simpson, W. D., Luecke, G., Cannon, D. L., and Clemens, D. H., "9900 Family Systems Design and Data Book", 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Division News), Boston, Mass., U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments' 9900 family, and suitable interface modules for working there with, an elevator control system of the type illustrated in FIG. S1, with separate controllers for the cabs, the cars, and the group, has been implemented utilizing real time interrupts, power on causing a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the control register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have neither before been performed. The invention is not related to performing with microprocessors that which may have in the past been performed with traditional ralay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 33, 34, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired.

Figure 2:
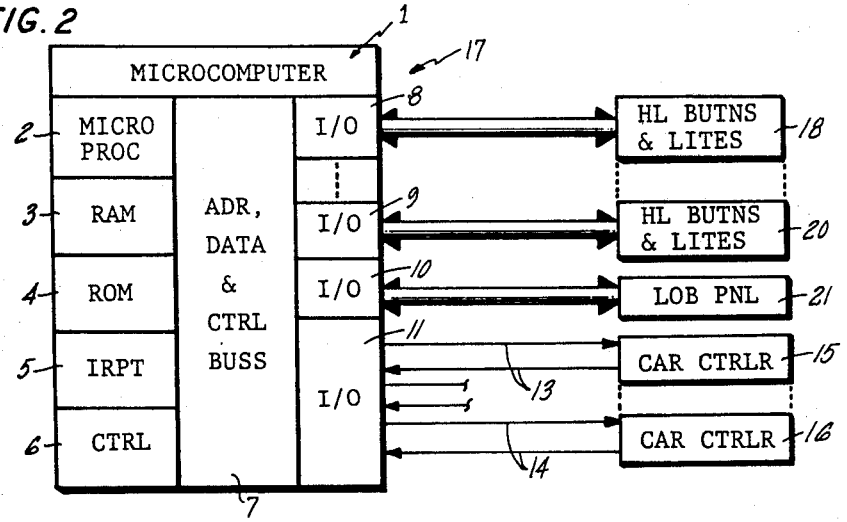
FIG. 2 is a simplified, schematic block diagram of a car controller, which may be employed in the system of FIG. 1, and in which the invention may be implemented.

Referring now to FIG. 2, a group controller 17 is illustrated simply, in a very general block form. The group controller is based on a microcomputer 1 which may take any one of a number of well-known forms. For instance, it may be built up of selected integrated circuit chips offered by a variety of manufacturers in related series of integrated circuit chips, such as the Texas Instruments 9900 Family. Such a microcomputer 1 may typically include a microprocessor (a central control and arithmetic and logic unit ) 2, such as a TMS 9900 which is TIM 9904 clock, random access memory 3, read only memory 4, an interrupt priority and/or decode circuit 5, and control circuits, such as address-/operation decodes and the like. The microcomputer 1 is generally formed by assemblage of chips 2-6 on a board, with suitable plated or other wiring so as to provide adquate address, data, and control busses 7, which interconnect the chips 2-6 with a plurality of input/output (I/O) modules of a suitable variety 8-11. The nature of the I/O modules 8-11 depends on the functions which they are to control. It also depends, in each case, on the types of interfacing circuitry which may be utilized outboard therefrom, in controlling or monitoring the elevator apparatus to which the I/O is connected. For instance, the I/Os 8-10 being connected to hall call buttons and lamps and to switches and indicators may simply comprise bufferred input and buffered output, multiplexer and demultiplexer, and voltage and/or power conversion and/or isolation so as to be able to sense hall or lobby panel button or switch closure and to drive lamps with a suitable power, whether the power is supplied by the I/O or externally.

An I/O module 11 provides serial communication over current loop lines 13, 14 (FIG. 1) with the car controllers 15, 16 (FIGS. 1 and 2). These communications include commands from the group controller to the cars such as higher and lower demand, stop commands, cancelling hall calls, preventing lobby dispatch, and other commands relating to optional features, such as express priority and the like. The group controller initiates communication with each of the car controllers in succession, and each communication operation includes receiving response from the car controllers, such as in the well known "handshake" fashion, including car status and operation information such as is the car in the group, it is advancing up or down, its load status, its position, whether it is under a go command or is running, whether its door is fully opened or closed, and other conditions. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends in unnecessary and not included herein.

Figure 3:
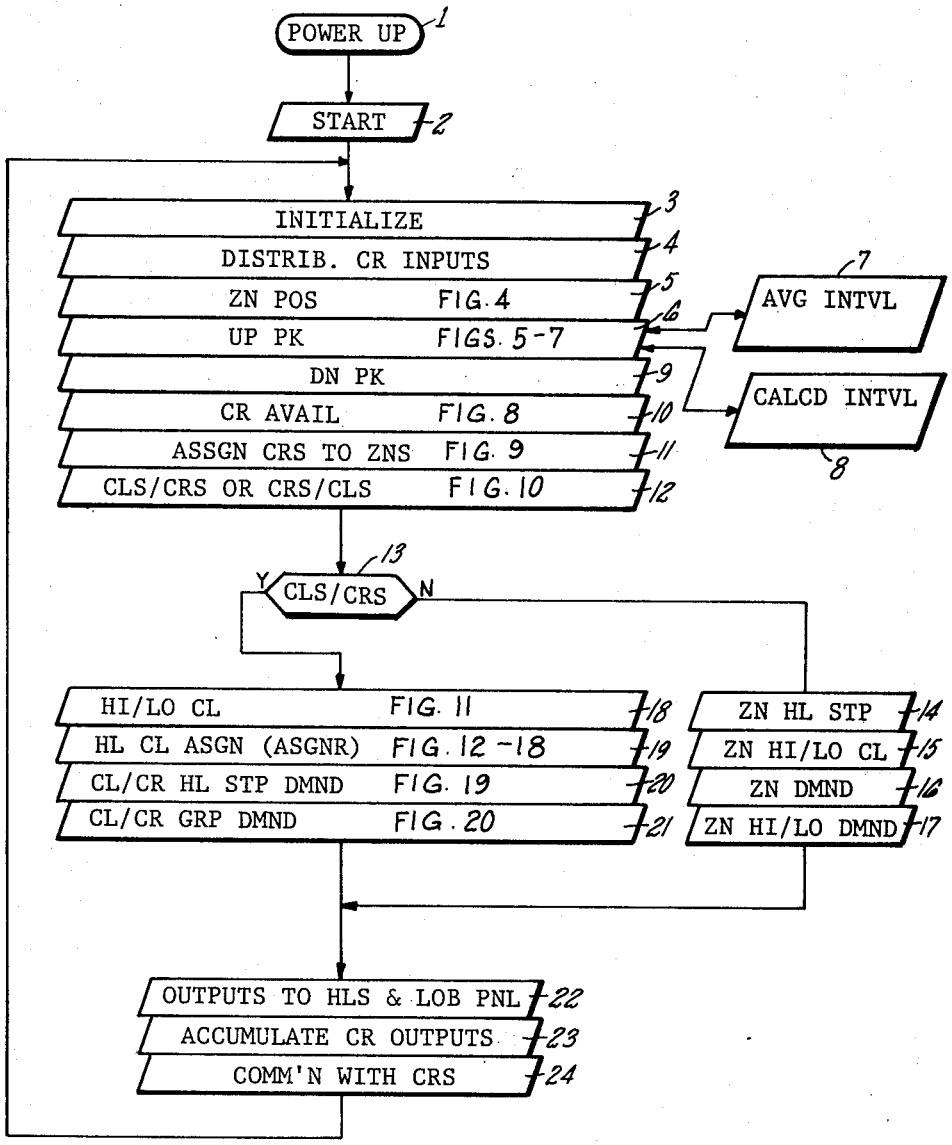
FIG. 3 is a simplified logic flow diagram of an overall group controller program which may incorporate and utilize the present invention.
Figure 5:
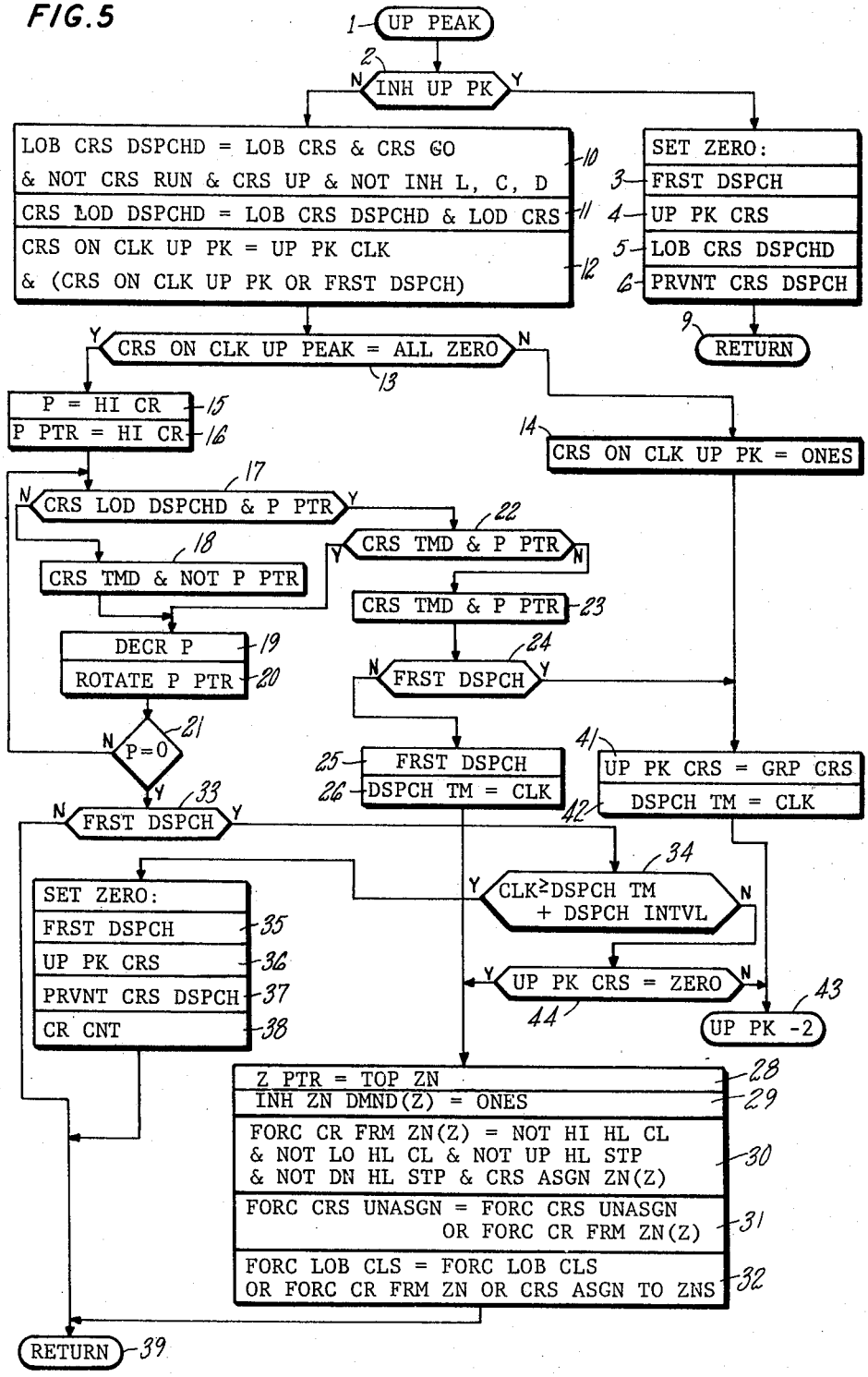
FIGS. 5–7 are logic flow diagrams of an up peak routine.
Figure 6:
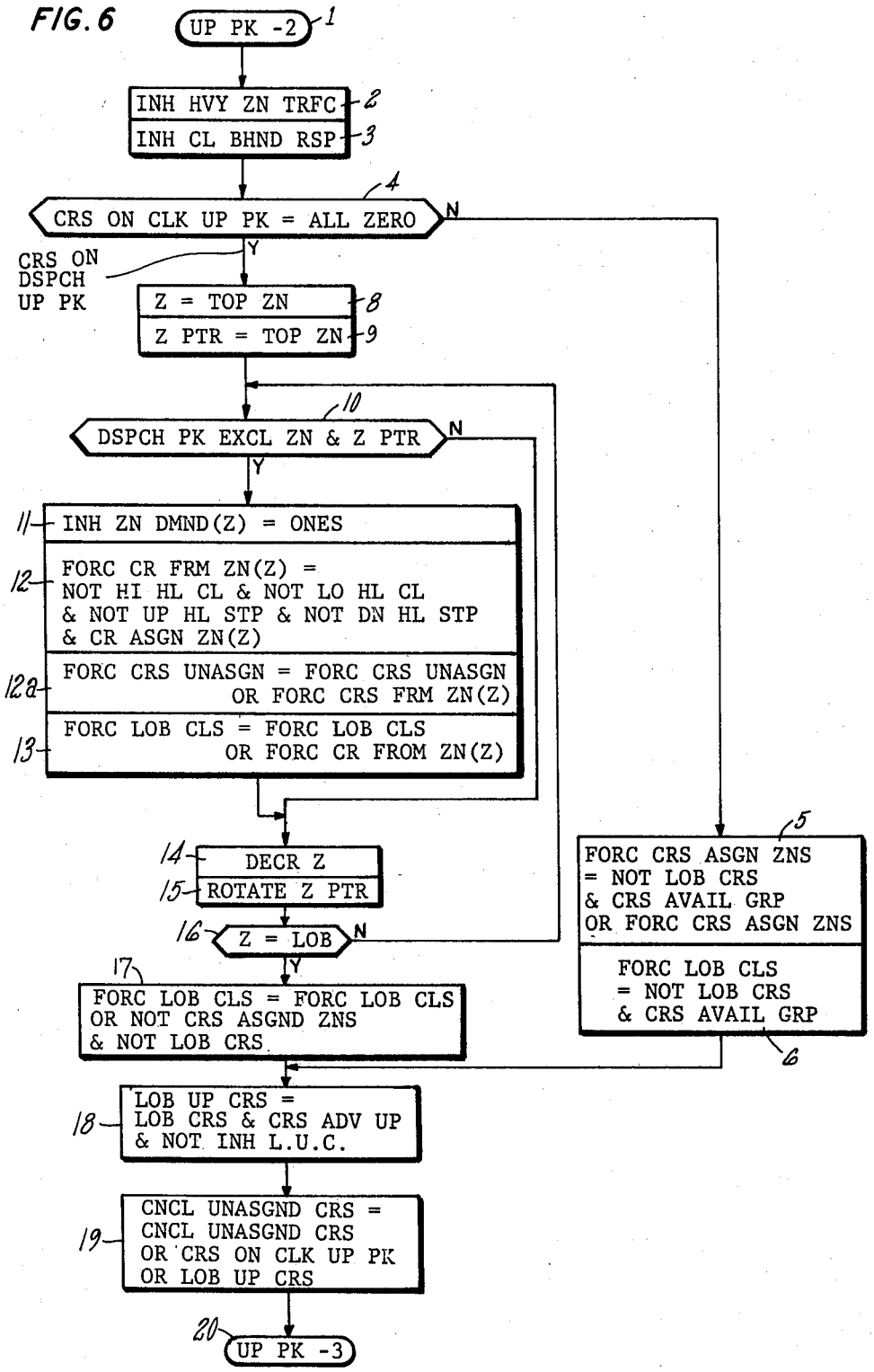
Figure 7:
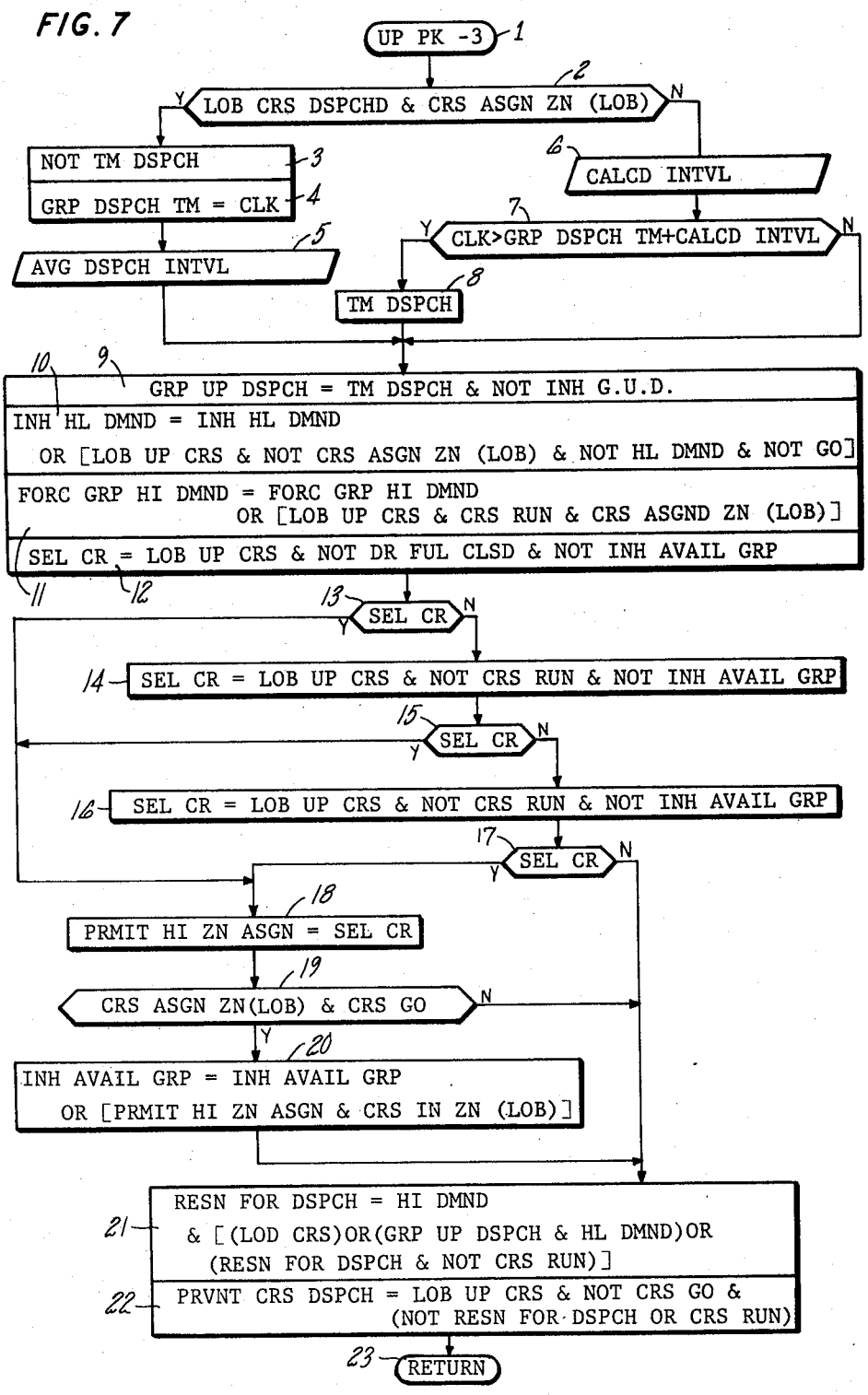

Overall program structure of a group controller, based upon a data processing system, in which the present invention may be practiced, is illustrated in FIG. 3 and is reached through a program entry point 1 as a consequence of power up causing the highest priority interrupt, in a usual fashion. Then a start routine 2 is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine 3 in which all forcing (FORC) and all inhibit or cancel (INH) functions are cleared from memory; field adjustable variables are read and formatted as necessary; the status of each car is read and formatted as necessary; and all the hall calls are scanned, and corresponding button lights for sensed hall calls are lit. Then, all inputs obtained by communication with the cars are distributed to the various maps and other stored parameter locations relating thereto in a routine 4. Then, a zone position routine 5 (described more fully hereinafter with respect to FIG. 4) is performed to identify the cars in each zone and to identify the zone in which each car is. Then, an up peak routine 6, including an average interval subroutine 7 and a calculated interval subroutine 8, which is described more fully hereinafter with respect to FIGS. 5-7, is performed to determine if there is up peak traffic, and if so to perform the various functions required, depending upon the level of traffic involved. Then, a down peak subroutine 9 may be performed to see if two cars in succession have reached the lobby with at least a half of load, and if so, to establish down peak zone operation by setting the down peak cars map to all ones (in a manner which becomes apparent as described with respect to the up peak routine hereinafter), forcing cars that are in the lobby away from the lobby, and forcing a zone group higher demand to ensure that cars will distribute themselves upwardly to the top of the building in order to bring more passengers down. Since this forms no part of the present invention, but is simply part of the overall environment in which the invention may be practiced, further description thereof is not given herein.

In FIG. 3, a car availability routine 10 updates the status of cars that are available to satisfy demand in the group, that are available for assignment to zones, and that are available to occupy zones, as is described more fully hereinafter with respect to FIG. 8, in preparation of performing the assigning cars to zones routine 11, which is described more fully hereinafter with respect to FIG. 9. Then the mode of operation, whether calls should be assigned to cars or cars should be assigned to calls, is established in a floor-to-cars or cars-to-floors subroutine 12, which is described more fully hereinafter with respect to FIG. 10. If calls are to be assigned to cars as determined in a test 13, then the program continues with a plurality of routines which assign cars to calls and create response of the cars to the assignments, utilizing relative system response as the criteria. On the other hand, if cars are to be assigned to floors, test 13 will be negative and a plurality of routines are performed, which assign cars to floors, in a type of elevator group control in which the building and therefore the calls therein are divided into a plurality of zones, as is known to the art.

The assignment of cars to calls as a consequence of cars being assigned to zones, and zone response to calls being indicated (such as during up peak or down peak traffic) is accomplished by creating demand for unoccupied zones so that cars can be assigned to them (except when cars are all forced into the assigned condition during clock up peak), determining the highest and lowest calls in the zone, generating group higher and lower demand signals for the cars to reach the calls in their zones, or to reach an unoccupied zone if a car is unassigned, or to respond to forced calls, such as lobby calls during up peak traffic.

Since these functions are generally known, and form no part of the present invention, detail logic flowcharts for achieving them are not shown herein, but the nature thereof will be described.

Specifically, in FIG. 3, a zone hall stop routine 14 updates a current map of cars requiring up hall stops or down hall stops at their committable positions, and resets hall calls (and corresponding button lights) of those indicated by the cars to have been answered. A zone high and low call routine 15 determines, for each zone of the building, the floor at which the highest and lowest hall calls are currently extant and require service. A zone demand routine 16 determines all the cars below the highest empty zone and creates higher demand to try and drive any of them that are available upward to fill the zone, and similarly determines all the cars above the lowest empty zone and creates zone demand to attempt to drive any available cars downward into the lowest empty zone. And a zone high/low demand routine 17 creates higher and lower zone demand within the respective zones to reach the highest and lowest hall calls, and then creates maps of higher and lower demand for cars in the zones to answer the calls, for unassigned cars to answer zone demands to fill empty zones, and to respond to forcing of demands or forcing of lobby calls. These routines are not new, and need not be described further, particularly in the light of similar routines described herein. They provide, however, a more complete description of the environment of the invention.

In FIG. 3, if test 13 is affirmative, then calls are assigned to cars by first performing a high/low call routine 18 which finds the highest and lowest car calls, up hall calls, and/or down hall calls in the entire building, as described more fully with respect to FIG. 11 hereinafter. Then, a hall call assignment routine 19 (FIGS. 12–18) assigns all up hall calls and all down hall calls to cars, in dependence on a plurality of variables, employing the relative system response factors of the invention described and claimed in a commonly owned copending U.S. patent application filed on the even date herewith by Bittar, Ser. No. 099,790. In the routine 19, each call is assigned to a specific car for response; but in accordance with an invention described and claimed in a commonly owned copending U.S. patent application filed on even date herewith by Bittar, Ser. No. 099,945, the calls are updated every time the routine of FIG. 3 is performed, thereby allowing improved assignments in accordance with changes in conditions. Since the routine of FIG. 3 is performed, in the embodiments herein, every 200 milliseconds or the like, this means that conditions that change in much less time than it takes a high-speed run past a floor without a stop, can be included in improving the assignment of calls to specific cars. The results of the calls to cars assignment which take place in the routine 19 are utilized in a call/car hall stop demand routine 20, which is described more fully hereinafter with respect to FIG. 19. And the running of all cars to which calls are assigned is controlled by a call/car group demand routine 21, which is described more fully hereinafter with respect to FIG. 20.

In FIG. 3, regardless of whether calls are assigned to cars or cars are assigned to floors, the results of all of the routines on FIG. 3 are outputted appropriately once in each cycle. For instance, an outputs to halls and lobby panel routine 22 may provide direct discrete outputs, operate lights and the like, as is deemed appropriate in the various hallways and at the lobby panel. An accumulate car outputs routine 23 sorts out the information relating to respective cars into car format, in preparation of performing a communication with the cars routine 24, which may utilize the serial (communication register unit) method of providing each car with updated information, or may provide it over parallel data buses, if desired. And then, the routine repeates by again commencing through the initialize routine 3, as described hereinbefore.

Figure 4:
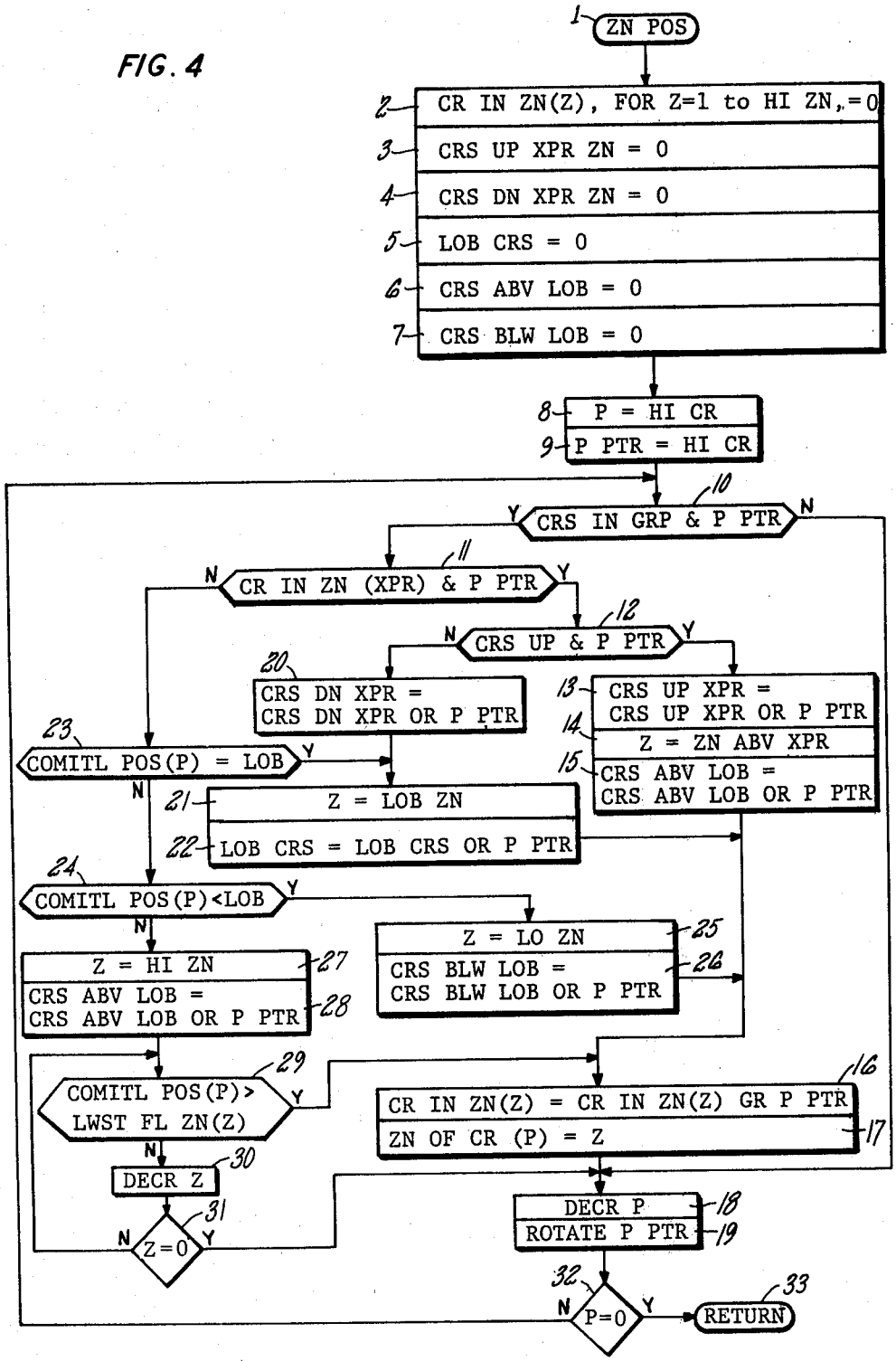
FIG. 4 is a logic flow diagram of a zone position routine.

The zone position routine is illustrated in FIG. 4 is reached through an entry point 1 and commences by resetting to all zeros, maps of cars in zones, for each zone from one to the highest zone in step 2, cars traveling up in the express zone in step 3, cars traveling down in the express zone in step 4, lobby cars in step 5, cars above the lobby in step 6, and cars below the lobby in step 7. Then a P number and a P pointer are set to the highest car in the group in steps 8 and 9. Test 10 interrogates whether the car indicated by the P pointer is in the group; if not, the functions of this routine are bypassed with respect to that car. But if so, test 10 is affirmative and a test 11 determines whether this car indicates that it is running through an express zone. If it was, then the map of cars which are traveling up as compared with the P pointer in a test 12 and an affirmative result indicates that the car is traveling up in the express zone and updates a map thereof in step 13. Then a zone number is set to be equal to the zone above the express run in a step 14 and the cars above lobby map is updated by ORing the P pointer into it in step 15. Then, in a step 16 a map of cars for the zone Z set in step 14 is updated by ORing the P pointer into it, which is permissible because it is initially reset in step 2, hereinbefore. Then a number indicative of the zone in which the car P is situated is set equal to the zone Z (identified in step 14 above) in step 17.

In FIG. 4, steps 18 and 19 cause the next lower car to be identified so that test 10 can be repeated for a second car in the group. Assuming that the car is in the group and is in an express zone as before, test 12 will determine whether the car is running up or not. If it is not running up, then it is running down so that a step 20 will update a map of cars running down in the express zone by ORing the P pointer into it. In such a case, the next zone to be encountered is the lobby zone so that Z is set equal to the lobby zone in step 21 and a map of cars at the lobby is updated by ORing with the P pointer in step 22. The map of cars in the lobby zone is then updated in step 16 and the zone of car P is set to the lobby zone number in step 17 as before. Steps 18 and 19 thereupon are decremented to relate to a third car in the group. Assuming for descriptive purposes that step 10 is affirmative but the third car being considered is not in the express zone, test 11 will be negative. This will cause a test 23 to determine if the committable position of the car (which is provided to the group controller by the car controller) is the lobby. If it is, the action is the same as for a car running down in the express zone as described hereinbefore. But if not, then a test 24 determines if the committable position is lower than the lobby. If it is, Z is set equal to the low zone (which is assumed to be a zone below lobby in the general case) in a step 25 and the map of cars which are below the lobby is updated by ORing with the P pointer in step 26. Then the zone and car status are again updated in steps 16 and 17 and the next car is reached by steps 18 and 19.

In FIG. 4, assume that the fourth car interrogated results in an affirmative response to test 10 and negative responses to tests 11, 23, and 24. In such a case, the particular zone involved (which by this time is known not to be the lobby or the low zone and not to relate to the car having previously been in an express zone). A step 27 sets a zone number equal to the highest zone in the building. And a step 28 updates the map of cars above the lobby by ORing the P pointer into it. Then, a test 29 determines if the committable position of the car under consideration is greater than the lowest floor in the zone Z (which is provided by a map of floors in each of the zones, and the selected zone Z has its map compared with the committable position of the car P in step 29. If it is, this indicates that the car is in the zone and that fact is registered for the car and the zone in steps 16 and 17 as described hereinbefore. Then steps 18 and 19 pick yet another car, and assuming that step 27 has previously been reached, it will be reached again. And if even the fifth car is still in the zone, step 29 will again be affirmative so that both this car and the last car may be identified as being in that zone. But if step 29 is negative, the zone is decremented in a step 30 and if it has not reached zero (below the lowest zone) as indicated in a step 31 then this car, P, will be tested against the next lower zone to see if its committable position is higher than the lowest floor in the next lower zone. Ultimately, all of the cars will be identified as being in one of the special zones (lobby, low zone, or zone above express, or the express zone itself, or any other zone at the high end of the building). Notice that express zones do not have cars assigned to them, but are simply identified as being there, since no service is to be provided in an express zone.

In performing the routine of FIG. 4, more than one car may be assigned to the same zone and the passage through the routine is dependent simply upon the conditions relating to a given car with respect to the zones of the building, as described hereinbefore. The manner in which a car is determined to be in the express zone, for interrogation in step 11, is through the test 29, described hereinbefore. Thus, step 29 will initially identify the car as being within an express zone in one pass through the program of FIG. 4, and its status as being heading for the lobby zone or the first zone above the express zone will take place in subsequent passes through the program of FIG. M2. When all of the cars have been tested, a test 32 will determine that P=0, and the program will return to the main program by means of a transfer point 33.

In the embodiment herein, after the zone position subroutine of FIG. 4, the main program will call other programs, some of which are described hereinafter.

The up peak routine is entered through an entry point 1 on FIG. 5 and a test 2 determines if up peak is inhibited for some reason (such as fire service or the like). If it is, then steps 3–6 reset the first dispatch flag and sets the following pointers to all zeros: up peak cars, lobby cars dispatched, prevent cars dispatch, and others, depending on the implementation. And the main program is returned to through a return point 9. In the usual case, however, test 2 of FIG. P1 will be negative so determination of whether or not incoming traffic merits up peak handling by the group controller is to be made. In a step 10, a lobby cars dispatched map is determined as the AND of maps indicating lobby cars, cars with go signals, cars not running, and cars set with their advance direction up, provided lobby cars dispatch is not inhibited. In a step 11, a cars loaded-and-dispatched map is determined as the logical AND of the lobby cars dispatched map and the loaded cars map (each car determining that it is more than half full by weight). And step 12 updates the map of cars on clock up peak by ORing the first dispatch flag into one bit of that map, and ANDing the same bit with the up peak clock flag. The up peak clock flag may either be a key switch with which lobby personnel determine when timed up peak is to occur, or could be a simple 24 hour timer, that would provide a discrete signal at a certain period of the day, such as between 8:30 and 9:30 am. If the up peak clock is on, clock up peak is still not entered into unless at least the car leaves the lobby with a load (at least half full). This avoids going into up peak on weekends and holidays simply because of the time of day, when a timer is used. The difference between clock up peak and load dispatched up peak is controllable, from one installation to the next, but clock up peak will normally be retained throughout the clock period, once it is entered, even though there are periods of low traffic at the lobby, because the morning rush tends to come in bunches, such as from buses and subways that deposit a lot of people near the building at one time, and this must be anticipated by continuing to bring all of the cars back to the lobby to handle the heavy up flow of traffic. On the other hand, load dispatched up peak continues only so long as the heavy traffic continues, as determined by successive cars, leaving at least half full within a dispatch interval, but ending when the interval exceeds a certain time. This type of peak is more likely to occur such as at the end of the noon hour when the incoming traffic is rather sporadic and will not necessarily continue for a determinable period of time. There are other differences in the embodiment herein, as become apparent hereinafter.

In FIG. 5, a test 13 determines whether step 12 has inserted any bit at all in the cars on clock up peak map. If it has, then this map will not be all zeros, so that it is converted in a step 14 to all ones, assigning all the cars to clock up peak status.

But if test 13 in FIG. 5 is affirmative, the up peak clock is not on, so the determination of whether loaded cars are leaving within small dispatch intervals is made. To do this, it is necessary to consider each car, one at a time, distinguishing one car from the next, and determining when successive distinct cars have left the lobby with a load. The timing is compared against a dispatch interval, a load up peak is declared. Steps 15 and 16 set a P number and a P pointer to the highest numbered car in the building. Then the map of cars loaded and dispatched (step 11) is compared with the P pointer to see if the car under consideration is about to leave the lobby with a load. If not, this particular car is not involved, but because it may previously have been, a map of cars which have been considred in dispatch timing has the car under consideration removed from it, in a step 18. And the P number and P pointer are lowered to the next-numbered car in steps 19 and 20, P is tested for zero to determine if the last car has been considered in test 21. If the last car has not been considered, the routine returns to test 17. If the next car under consideration is loaded and about to be dispatched from the lobby, test 17 will be affirmative. If this car has not previously been so determined, a test 22 will be negative so that the map of cars timed for dispatch considerations will be updated in step 23 to add this car to the map. Then a first dispatch flag is interrogated in test 24 to see if a previous dispatch has occurred for which there if currently running a time interval. If not, test 24 is negative and the first dispatch flag is set in step 25 and the dispatch time for this car is set to equal the time of a real time clock in step 26. Then, because one car has left fully loaded, a first, low level of up peak operation is entered into in steps 28–32 by excluding demands in the highest zone, forcing the cars out of the highest zone, forcing these cars to be unassigned, and creating lobby calls (such as by forcing car calls within the cars) in the cars forced from the highest zone of the building. In step 28, a zone pointer is set to the top zone. Then all cars are inhibited from having zone demand in the top zone by setting the corresponding map to ones in step 29. A map of cars to be forced from the top zone is then established by ANDing the maps of cars without high hall calls, cars without low car calls, cars without up hall stops, cars without down hall stops (representing activity that must be completed by the cars) and cars assigned to the top zone (so that this only affects those in the excluded, top zone) all in step 30. And step 31 forces such cars to unassigned status while step 32 updates the map of forcing lobby calls by Oring that map with the maps of cars forced from the top zone and of cars assigned to the top zones. This provides all cars with lobby calls but lets most cars respond to other calls in their assigned zones, during this limited form of up peak operation. Then this routine is ended and returns to the main program by a return point 39.

In the next pass through the up peak routine of FIG. 5, assume test 2 is negative, test 13 is negative so that steps 15 and 16 again establish the high car to be examined first, and step 17 will be negative for all cars which are not about to leave the lobby with a load. If the car which has previously been ready for dispatch with a load as described above is still at the lobby, test 17 will be affirmative; this may occur if the up peak routine is run on a 200 millisecond basis, or so, since several seconds are required following a go signal in order to close the doors of the car, and if a door reversal is caused by a late passenger hitting the safety switch, even more time may be involved. So if this car is still awaiting dispatch with a load at the lobby, test 17 will be affirmative but test 22 will also be affirmative this time so that the dispatch time is not altered in step 26. This is an indication of the need to keep track of each individual car in establishing whether or not two cars have left the lobby loaded within a given interval. But if a second car has become loaded and ready for dispatch, test 17 will be affirmative for that car but test 22 will be negative for that car. Such a car will be added to the map of cars which have been timed in step 23 but test 24 will be affirmative so that a full fledged up peak is indicated (almost in the same fashion as a clock up peak which is indicated by a negative result of step 13 described hereinbefore). This is described more fully hereinafter.

But if test 17 in FIG. 5 is negative for all other cars during this pass through the routine, the map of cars timed is reenforced to not include any such cars in step 18, and all cars are considered by proceeding through the P number and P pointer in steps 19 and 20 and determining when all cars have been considered in step 21. Whenever step 17 is negative or step 22 is affirmative for all of the cars, test 33 is reached to determine if only one car has been dispatched with a load. This is the normal case when a single car happens to have a load and leave the lobby, but within several passes through the routine of FIG. 5, no other cars leave the lobby with at least a half load. In such case, test 33 is affirmative so that a test 34 is made to see if the clock time exceeds the time of dispatch of the first car plus some predetermined dispatching interval within which two cars must leave the lobby in order to declare an up peak condition. If the time has passed, that means the interval has been exceeded, and having only dispatched one loaded car, an up peak is not indicated. In such a case, the first dispatch flag is reset in a step 35, the map of up peak cars is set to all zeros, because this is an indication of the end of an up peak. Even clock up peaks end after expiration of the clock, bypassing through this portion of the routine, due to test 13. The map of preventing cars from being dispatched is set to all zeros in step 37 so that car dispatching at the lobby can be based on ordinary car considerations, rather than group up peak control, and a car count (used in the up peak routine of FIG. 8, as described hereinafter) is reset to zero in step 38. This is the manner in which a nonclock up peak is ended, and the routine is exited (since the up peak functions about to be described hereinafter) need not be performed and the program returns to the main program through a transfer point 39.

In the case where no cars are leaving the lobby half full, test 13 will be affirmative, 17 will be negative, and 33 will be negative in every pass through the routine of FIG. 5, so that no up peak considerations need be made at all, and the up peak program returns to the main program through the transfer point 39.

In the case where one car has left the lobby loaded, and in subsequent passes through the routine of FIG. 5, no other cars are determined to have left the lobby loaded, step 33 will be reached as described hereinbefore; but if the timer has not timed out as indicated by a negative result of test 34, then a test 40 is made to determine whether up peak has previously been ordered by determining whether the map of up peak cars has any ones in it or not. If not, the test 44 will be affirmative and the single zone exclusion, called into play by a single car leaving the lobby with half a load, is continued as described with respect to steps 28–31 hereinbefore. But if up peak has been established for any car, test 44 will be negative, and the up peak will continue. This test comes into play at the end of a previously established load-created up peak operation (in contrast with a clock up peak) so as to continue the second level up peak operation, excluding more than the top zone, until such time as no second car has left within the up peak interval as determined by strap 34, when the load-created up peak will end.

As described hereinbefore with respect to the routine of FIG. 5, if test 13 is negative or if test 24 is affirmative, up peak group operation is commanded by entering a step 41 which sets the map of up peak cars equal to a map of all the cars in the group. The dispatch time is updated in a step 42 in each pass through the routine of FIG. 5 during a bonafide up peak operation to permit determination of when the operation should end (when two successive cars have not left the lobby half loaded within the interval, or when following the time out of the clock, successive cars have not left the lobby half loaded within the dispatch interval). The testing of the timer when set in step 42 will be in step 34 as described hereinbefore under conditions where the group is not on clock up peak, and only one car has as yet been determined to have left since the last setting of the dispatch time by the clock in step 42. Whenever the clock is off, and the traffic slows down so that test 34 is reached and is affirmative, the up peak will end as described with respect to steps 35–38 hereinbefore.

In the routine of FIG. 5, the difference between continuing an up peak and determining if up peak can end is expressed by reaching a transfer point 43 (that continues the up peak operation by) means of test 44 when the up peak may be ending, rather than by tests 13 or 24 when the up peak is known to be continuable through at least another cycle. In any event, the routine of FIG. 5 will pass through the transfer point 43 to the continuation of the up peak routine in FIG. 6 by means of transfer point 1 thereon. In FIG. 6, steps 2 and 3 inhibit the zone functions called heavy zone traffic and call behind response, if such are included in the zone operation characteristics of a given installation. These have to do with whether or not calls to subfloors below the lobby are to be allowed, and change of car advance direction to answer calls in a zone where the car is assigned. They have nothing to do with the present invention and are not described herein.

In the routine of FIG. 6, a test 4 determines whether the group is on a clock-generated up peak, or on an up peak generated simply by two cars leaving the lobby half loaded within a dispatch interval. The difference is the number of zones which may be excluded from normal operation and thereby release cars to be forced to the lobby to continuously serve the lobby during the up peak. When a clock up peak is involved, a larger number of zones is normally excluded, typically all of the zones in the group, to make all of the cars available to serve the up peak traffic. But when load determined up peak is involved, since it is not known how long the up peak will last, and it may be of short duration, a fewer number of zones (such as three or four) may be forced to release their cars to serve the lobby. Specifically, if test 4 is negative, indicating that the map of cars on clock up peak has some ones in it, a step 5 forces a map of cars assigned to zones to be updated by Oring it with itself and with the logical AND of a map of cars available to the group and a map of cars which are not presently at the lobby floor. Then a step 6 updates a map of cars in which lobby calls should be forced by loading it with the logical AND of a map of cars and the map of cars which are available to the group set in step 5.

In FIG. 6, if test 4 determines that the up peak is not an up peak clock controlled up peak, but rather one caused by dispatching of two loaded cars within the dispatch interval, then the functions of providing cars to service the dispatch is done to less than all of the zones. Steps 8 and 9 set a zone number and a zone pointer to the top zone in the building. Then, a test 10 determines if the indicated zone is one of the zones which have been established as zones to be excluded thereby freeing cars for up peak service during a dispatch-created up peak. If it is such a zone (and normally the top two zones will usually be so allocated, although additional upper zones may also be allocated, then the test 10 is affirmative and steps 11–13 inhibit all zone demand against cars in the zone, force the cars from the zone and force lobby calls, as is described hereinbefore with respect to steps 29–31 of FIG. 5. Then steps 14 and 15 (FIG. 6) advance to the next lower zone, and until a test 16 determines that all of the zones have been considered down to but not including the lobby zone, the process is repeated. But when test 16 indicates that the zone to be considered is the lobby zone, the consideration is ended and a step 17 updates the map of cars in which calls to the lobby are to be forced by Oring itself with the logical AND of a map of cars not assigned to zones and cars not presently at the lobby floor. This prevents forcing lobby calls in cars which are satisfying demand in any of the zones which are not excluded to serve and up peak, in addition to those cars forced to the lobby from the excluded zones as in step 13 hereinbefore.

In FIG. 6, steps 5 and 6, in contrast with steps and test 8–17, are one of the distinctions between a full fledged clock up peak, and a dispatch-created up peak.

In FIG. 6, any up peak continues with a step 18 which creates a map of lobby cars which are directed in the up direction as the logical AND of lobby cars, cars in which the commanded direction is up, and cars not inhibited from the map of lobby up cars. Then a step 19 creates a map of cars in which the unassigned condition is to be cancelled as the logical OR of itself, or of a map of cars on clock up peak, or of a map of cars at the lobby in the up direction (step 18). Then the up peak routine is continued by transferring from FIG. 6 at a transfer point 20 to a transfer point 1 in FIG. 7.

In FIG. 7, a test 2 determines by ANDing of two maps whether there are any cars that are lobby cars being dispatched (step 10, FIG. 5) which are cars assigned to the lobby zone. If there are, dispatch is prevented by resetting a time for dispatch flag in a step 3 and the group dispatch time is set equal to the real time indicated by a clock in a step 4. Then, an average dispatch interval prediction may be calculated in an average dispatch interval subroutine 5, as described and claimed in a commonly owned, cop ending U.S. patent application filed on even data herewith by Bittar and Mendelsohn, Ser. No. 099,394. This provides an indication, as each car is dispatched, of the anticipated time it will take for the car to return to the lobby, in dependence upon the particular car calls registered in the car. It then averages this for the last three cars to have been dispatched, to get an indication of the average dispatching interval for the current traffic load at the lobby. It also then compares this against the number of available cars in service to determine the expected interval between dispatching cars for the current load of lobby traffic.

In subsequent passes through the routine of FIG. 7, the test 2 must be negative since between performing the functions on FIG. 7 in two successive passes (200 milliseconds or so apart), the cars assigned to zones routine will have removed the particular car in question from the lobby zone since it has been dispatched with a go signal. It is therefore not any longer assigned to the zone. Therefore, test 2 will be negative and a calculated interval subroutine 6 may be performed as is described in said Bittar and Mendelsohn application. This routine utilizes the expected average dispatching interval and other factors, such as the number of cars at the lobby and whether a clock up peak or a dispatch-created up peak are involved, to provide a dispatching interval which will determine the time between dispatching of successive cars. But this invention may be practiced using a fixed dispatching interval (such as 20 or 30 seconds) aquired from a storage location, if desired, instead of using the subroutine 6, and eliminating the subroutine 5.

In FIG. 7, a test 7 determines whether the dispatching interval has expired by comparing the current time of the clock with the time when the last car was dispatched plus the calculated interval. If the time has not yet elapsed, dispatching of cars is still inhibited; but if the time has elapsed, test 7 will be affirmative and will set the time for dispatch flag in a step 8. And, in each pass through the routine of FIG. 7, a group up dispatch flag is generated if step 8 has indicated time for dispatch and the group up dispatch is not inhibited, in a step 9. Then, the inhibit hall demand map (which controls group demands and lanterns at various floors for all of the respective cars) is updated by Oring with itself the logical AND of maps indicating lobby up cars, cars not assigned to the lobby zone, but excluding cars which already have a hall demand or have a go signal. Among other things, this prevents hall lanterns at the various cars in the lobby until they get a go signal, but continues those hall lanterns until the cars lose the lobby assignment at the commencement of their up runs. A step 11 creates a map of cars in which group higher demand is forced by Oring that map with the logical AND of maps of lobby up cars, cars in the run condition, and cars assigned to the lobby zone. This will force an up lantern on any car running up to the lobby and assigned to the lobby zone.

In FIG. 7, the next function is to select the most preferable car to be dispatched next from among various cars at the lobby. First, a step 12 will set the selected car map to include only a car which is a lobby up car, in which the doors are not fully closed, and which is not inhibited from being available to the group. Then the map is tested to see if this combination of maps has come up with a selected car in a test 13. If not, the selected car map is set to include only lobby up cars, cars not in the run condition, and cars not inhibited from being available to the group, in a step 14. Again, this map is tested to see if there are any cars in it in a test 15, and if not the map is again created in a step 16 to include only cars which are lobby up cars, cars which are running and not inhibited from being available to the group. Thus, the first preference is for cars with the doors open, the second preference is for cars stopped at the lobby with the doors fully closed, and the last preference is for cars running into the lobby (step 16). If none of these are available, a test 17 is negative, but if any of tests 13, 15, or 17 is affirmative, a preferred lobby car is available and a permit higher zone map is set equal to the map of the selected car in a step 18. A test 19 is performed to see if the car assigned to the lobby zone map has a go signal, and therefore is being dispatched, so that another car should be assigned to the lobby for subsequent dispatch. If test 19 is affirmative, a car is selected from those within the map of preferred dispatch cars. The car so selected is then removed from being available to the group (since it will be dispatched on up peak service) by updating the map of cars inhibited from availability to the group by Oring it with itself and the logical AND of the permit higher zone map and the map of cars positioned in the lobby zone.

The routine of FIG. 7 concludes with establishing a reason for dispatch map in step 21, which is the logical AND of high demand map with any one of three other maps, one being loaded cars, another being the logical AND of group up dispatch and hall demands, and the third being the logical AND of reason for dispatch cars not running. Thus, if any car has a higher demand, it will have a reason for dispatch if it is loaded, or if there is a group up dispatch for that car and its hall demand is established (its hall light lit) or it has previously had a reason for dispatch and is not running. Then in step 22, a map of signals to prevent cars from being dispatched is generated as the logical AND of maps for lobby up cars, cars which do not have a go signal and cars which either have no reason to be dispatched or are running. This concludes the up peak routine, so the routine returns the main program through a return point 23.

Figure 8:
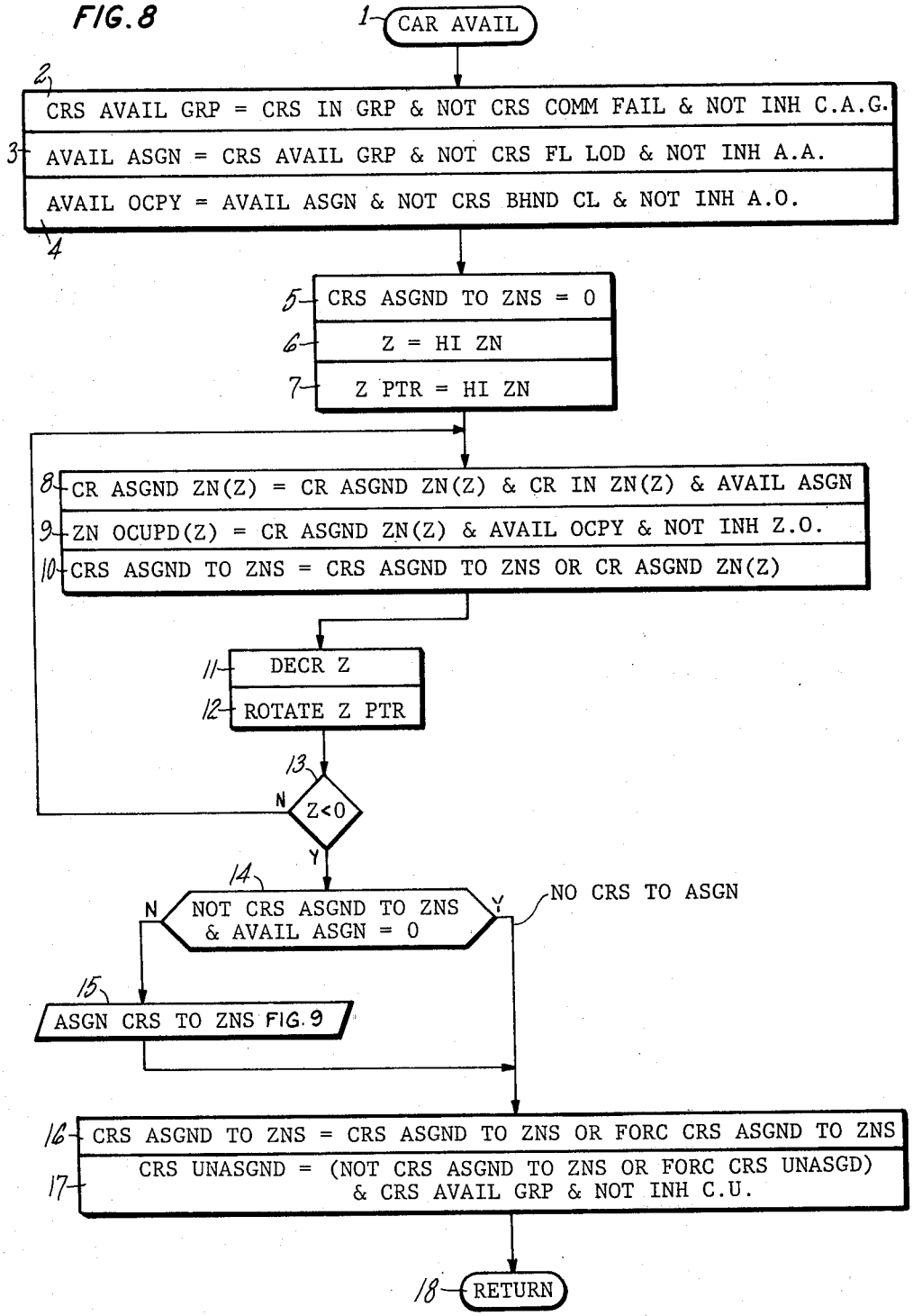
FIG. 8 is a logic flow diagram of a car available routine.

Referring now to FIG. 8, a car available routine is reached through an entry point 1. In step 2, a map of cars which are available to satisfy demand in the group (not disabled or on special service) is updated by ANDing the cars in group map (which is determined by each car telling the group that it is available and forming a map thereof), cars for which the group has not indicated a failure of the car to respond to it, thereby presuming communication failure with the car, and the complement of a map inhibiting cars available to the group. In step 3, a map of cars available for assignment is updated as the logical AND of maps indicating cars available to the group, the complement of a map of cars which are fully loaded (since a fully loaded car cannot be given further assignment) and the complement of a map inhibiting cars available for assignment. In step 4, a map of cars available for occupancy is updated as the logical AND of the map of cars available for assignment, the complement of a map of cars which are behind calls (in the event that such feature is employed during up peak or down peak zone assignments of the cars) and the complement of a map of inhibiting available for occupancy.

Step 5 of FIG. 8 resets a map of cars assigned to zones to zero. A zone number and a zone pointer are set to the highest zone of the building in steps 6 and 7. Then, in step 8, a map of cars assigned to the zone identified in steps 6 and 7 is updated by eliminating from it cars which are no longer in the zone or which have become unavailable for assignment. This is done by forming a logical AND of the map itself with a map of cars in the identified zone and the map of cars which are available for assignment. In step 9, the map of cars deemed to occupy a zone Z is updated as the logical AND of the cars assigned to the zone, cars that are available for occupancy and cars not inhibited from occupying a zone. In step 10, the map of cars which are assigned to all zones put together is updated as the logical OR of itself with the map of cars assigned to the particular zone Z under consideration. Then the next lower zone in sequence is identified by decrementing the zone number and rotating the zone pointer to a lower zone in steps 11 and 12 and if test 13 determines that the lowest zone has not yet been interrogated, steps 8 to 10 are repeated for each of the zones. When all of the zones have had their car status updates made in steps 8–10, a test 14 determines whether there are any cars available for assignment. If the complement of the map of cars assigned to zones and the map of cars available for assignment all equal zero, then there are no available, unassigned cars so that test 14 will be affirmative; but if step 14 is negative, then there is at least one available car for assignment by an assign cars to zones subroutine may be performed as is described with respect to FIG. 9 hereinafter. In either event, a step 16 further updates the cars assigned to zones map by ORing itself with a forcing map of cars assigned to zones. This forcing map may be used where it is desired to force cars to the highest or lowest zone during down or up peak intervals, or the like. And, a map of cars not assigned is updated by ORing into it a map of forcing functions for unassigning cars, and logically ANDing that with the maps of cars available to the group and a map of cars not to be inhibited from the unassigned status map. Completion of the program of FIG. 8 causes the main program to advance calls-to-cars or cars-to-calls subroutine (12, FIG. 3) through a transfer point 18. Before considering that program, attention is now directed to the assign cars to zones subroutine of FIG. 9.

Figure 9:
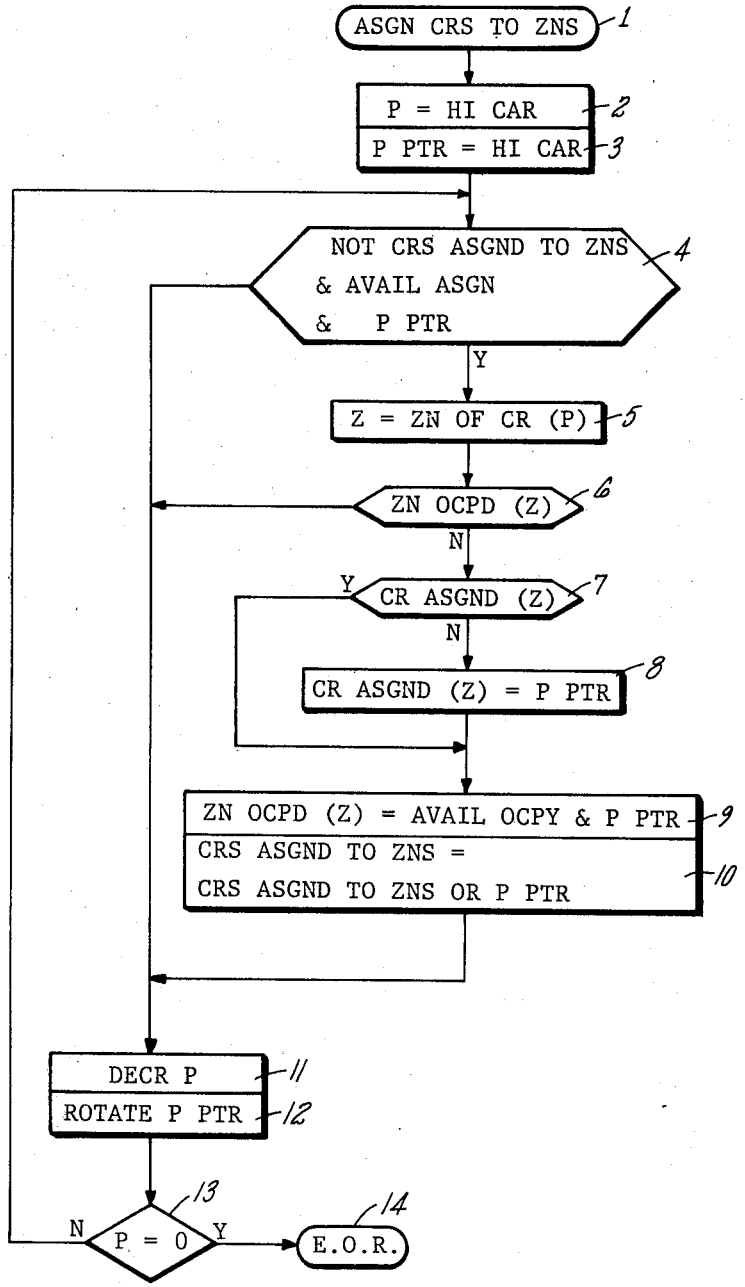
FIG. 9 is a logic flow diagram of an assign cars to zones routine.

The assign cars to zones subroutine is illustrated in FIG. 9, and reached through a transfer point 1. Steps 2 and 3 identify the highest numbered car in the building and test 4 determines if the particular car can be given a new assignment by ANDing the P pointer with the map of cars available for assignment and the complement of the map of cars already assigned to zones (in a fashion similar to test 14, FIG. 8 in general). If the car can be assigned, step 4 is affirmative and step 5 sets a zone equal to that where the car P is currently located as determined by the zone where car P number. Then, the determination is made as to whether the particular zone involved is already occupied in test 6. If the car is an already occupied zone, then this car cannot be assigned to that zone (there being another car already assigned there). So if step 6 is affirmative, no further operation is performed with respect to this particular car. But if the car is an unoccupied zone, test 6 is negative and test 7 will determine if the zone where the car is has a car assigned to it or not. The difference between a zone being occupied and having a car assigned to it is to be determined later. If the zone does not have a car assigned to it, test 7 will be negative and a step 8 will update the map of car identification assigned to the particular zone Z by loading it with the P pointer. Then, the zone occupied map for the zone Z will be updated by the P pointer if the car under consideration is within the map of cars available for occupancy of zones. In step 10, the map of all cars assigned to all zones is updated by ORing itself with the P pointer since car P has just become assigned to a zone. Then, the next lower numbered car in sequence is identified by decrementing the P number and rotating the P pointer in steps 11 and 12 and if a test 13 determines that the lowest car has not already been considered, the process is repeated for each car in sequence. When step 13 is affirmative, the subroutine is ended and will return to step 16 of the routine of FIG. 8 by means of a transfer point 14 (FIG. 9).

Figure 10:
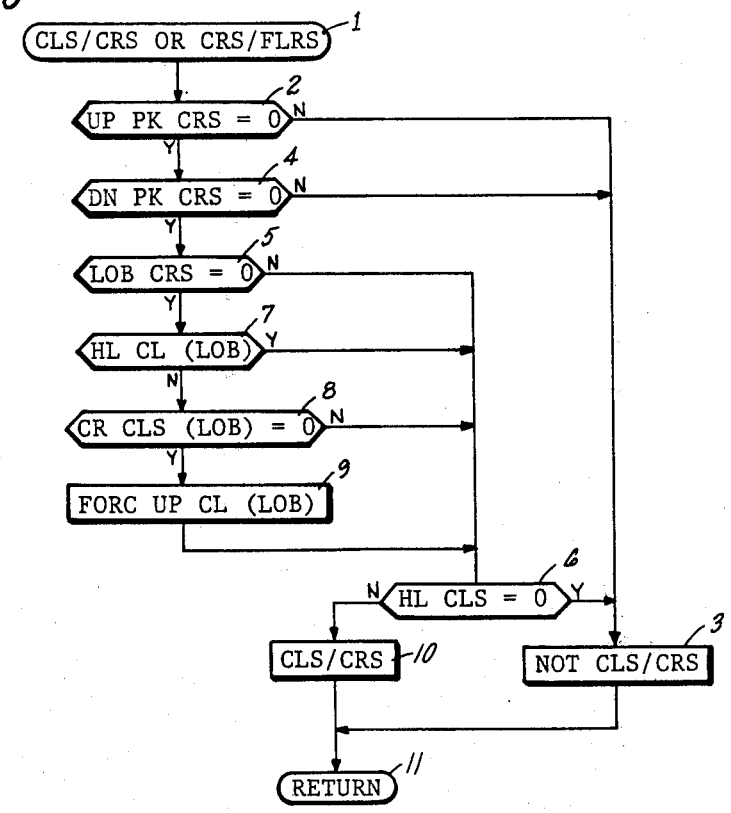
FIG. 10 is a logic flow diagram of a calls-to-cars or cars-to-floors routine.

Referring now to FIG. 10, the calls-to-cars or cars-to-floors subroutine is reached through an entry point 1. A test 2 determines if up peak clock is involved by examining all the bits of the up peak cars map. If all the bits are zeros, test 2 is affirmative, indicating that up peak operation for assignment of cars to floors has not been initiated. On the other hand, if test 2 is negative, then up peak mode of assigning cars to calls is required and a step 3 will ensure that the calls-to-cars flag is reset, or zero, which will command zone operation in the routines 14–17 (FIG. 3) to handle the up peak. Similarly, if a test 3 determines that the map of down peak cars is not all zero, then test 3 will ensure that operation will proceed through the zone routines 14–17 of FIG. 3 in order to handle the up peak mode of operation. But if steps 2 and 4 are affirmative, then no peak operation is required.

In FIG. 10, a test 5 determines if there are any lobby cars by sensing whether the map of lobby cars is all zero. If it is not, then there is at least one car at the lobby so that a test 6 will determine whether there are any hall calls or not. This is done by examining a map of all hall calls to see if it is zero. If it is, there are no hall calls, so step 3 will call for assignment of cars to calls by ensuring that the calls-to-cars flag is reset. This will cause the zone routines 14–17 (FIG. 3) to come into play and create zone demands to park all of the cars in a distributed fashion among the zones of the building. But if test 5 is negative, there is no car at the lobby. Then, a test 7 will determine if there is a hall call which will result in calling a car to the lobby. If not, a test 8 will determine if any car calls have been indicated for the lobby. The result of tests 5–8 is if there is no car and no call for a car to bring one to the lobby, a step 9 will add a lobby call to a map of forcing up calls, which will create, within the group control, an indication that a lobby call has been made. This is not an actual lobby call, and no light will be indicated at the lobby, unless the particular implementation of the invention provides for such. But it will cause the hall call assignment routine 19 (FIG. 3) to assign a car to the lobby so that there will be a car at the lobby if the cars are all parked (by virtue of there being no peak periods and no hall calls to serve, as indicated by tests 2, 4, and 6). And, this provides additional favoritism to the lobby in the assignment of calls to cars, as is described more fully with respect to the hall call assignment routine 19 (FIG. 3), hereinafter. And, because an up call is forced by step 9, the program proceeding thereafter through test 6 will cause a negative response to test 6 because the lobby up call which has been forced by step 9 will prevent step 6 from being affirmative. This causes a step 10 to set the calls-to-cars flag which is tested in test 13 of FIG. 3 and causes the calls-to-cars assignment method to be utilized, as described briefly hereinbefore. Since test 6 will always be negative when there is a lobby up call unanswered, any pass through step 9 or affirmative result of test 7 could lead directly to step 10, bypassing test 6, as desired.

In FIG. 10, assuming a first pass has determined that tests 2, 4, and 5 are affirmative, test 7 is negative and test 8 is affirmative, so that a lobby call is forced in step 9, a subsequent pass through this routine (such as 200 milliseconds later) will probably find that test 5 is still affirmative, meaning no car has reached the lobby. But step 7 will also be affirmative indicating that there is a hall call to the lobby. Therefore, test 6 will again be negative. This will continue until a car reaches the lobby, and the call/car hall stop demand routine 20 (FIG. 3) resets the lobby hall call (as is described more fully with respect to FIG. 19 hereinafter). At that time, test 5 will be negative because there will be a car at the lobby, and test 6 will be affirmative because the lobby call (having been answered) has been reset. With test 6 affirmative, step 3 will therefore cause reversion to the zone type of operation in which cars are assigned to floors. In any event, even when there are hall calls to be served, the routine of FIG. 10 will force calls for the lobby whenever there are no calls for the lobby and no cars at the lobby, so that the necessary preference for having lobby service will be effected. When the routine of FIG. 10 is completed, it returns to the main program of FIG. 3 through a return point 11.

Figure 11:
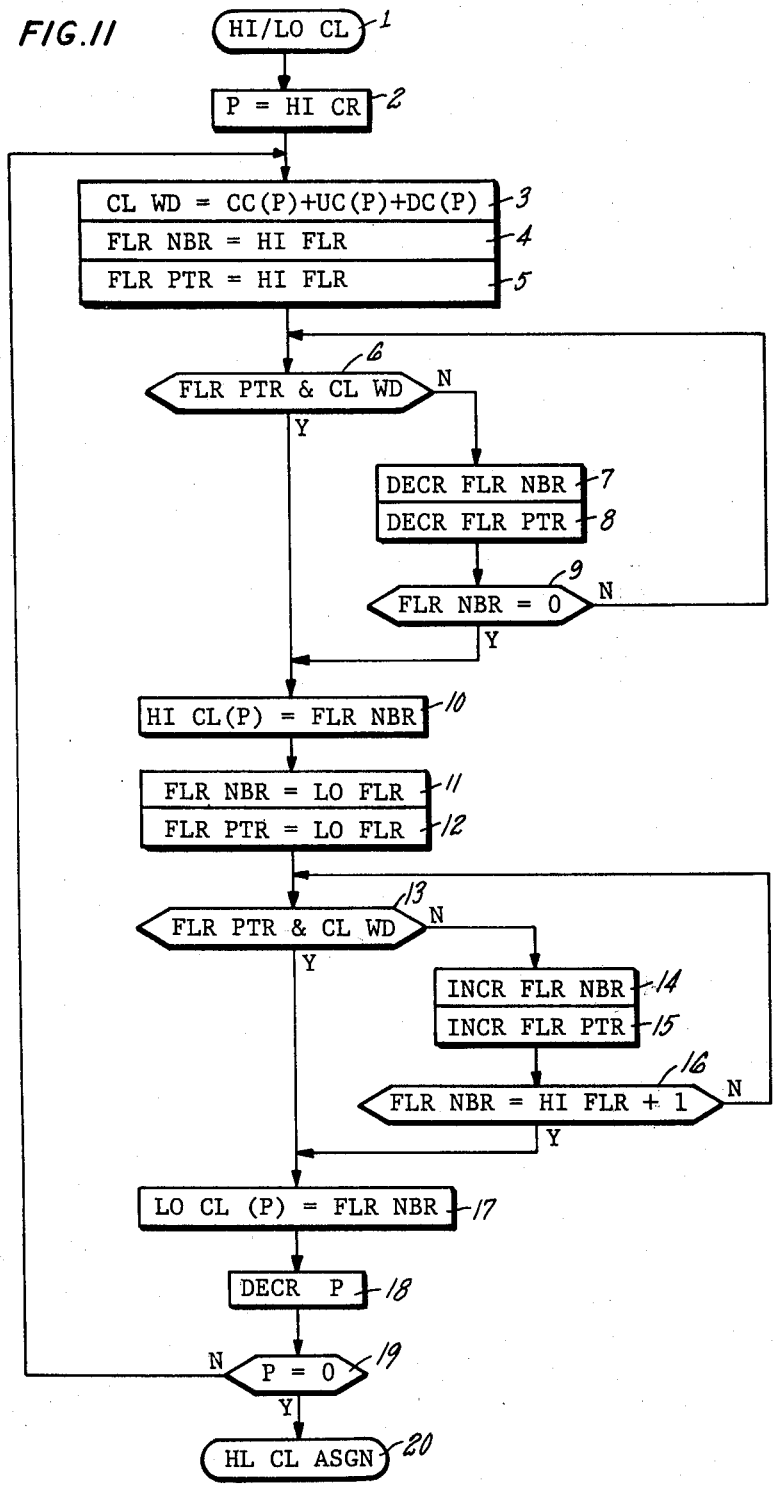
FIG. 11 is a logic flow diagram of a high/low cell routine.

Conclusion of the routine of FIG. 10 will cause the high/low call routine of FIG. 11 to be reached through an entry point 1. This routine determines the floor where each car has its highest call at the present moment and the floor where each car has its lowest assigned call at the present moment. The routine starts by step 2 setting a P number to the highest numbered car in the building. Then step 3 provides an assigned call word as the logical OR of all the car calls, up hall calls, and down hall calls for car P. A floor number and floor pointer are set to the highest floor in the building in steps 4 and 5, and a test 6 determines whether the floor pointer coincides with any assigned call in the call word. If it does not, then the floor number and floor pointer are decremented in steps 7 and 8 and if a test 9 determines that the lowest floor has not yet been considered, test 6 will be repeated for the next floor. The first time that step 6 encounters an assigned call at the floor under consideration, since this is starting at the highest floor, this will be an indication of the highest call assigned to the car. Therefore, an affirmative result from step 6 will go directly to a step 10 where a number indicating the floor of the highest assigned call for car P is set equal to the current floor number. Then, steps 11 and 12 will set the floor number and floor pointer to the lowest floor in the building. And in a fashion similar to that described above, a test 13 until the first call for car P coincides with the floor pointer, steps 14 and 15 will increase the floor under consideration, and the process will be repeated until a test 16 indicates that the highest floor in the building has been given consideration. The first time that test 13 is affirmative, this indicates that the lowest floor for which the car P has an assigned call has been reached, so that a step 17 will set the lowest call for car P equal to the current floor number. Then the next lowest numbered car in the building is brought into consideration by step 18 decrementing the P number, and test 19 determining that the lowest car (car 1) has not had its consideration. But when test 19 is affirmative, the program is complete and a hall call assignment program is reached through a transfer point 20.

Figure 12:
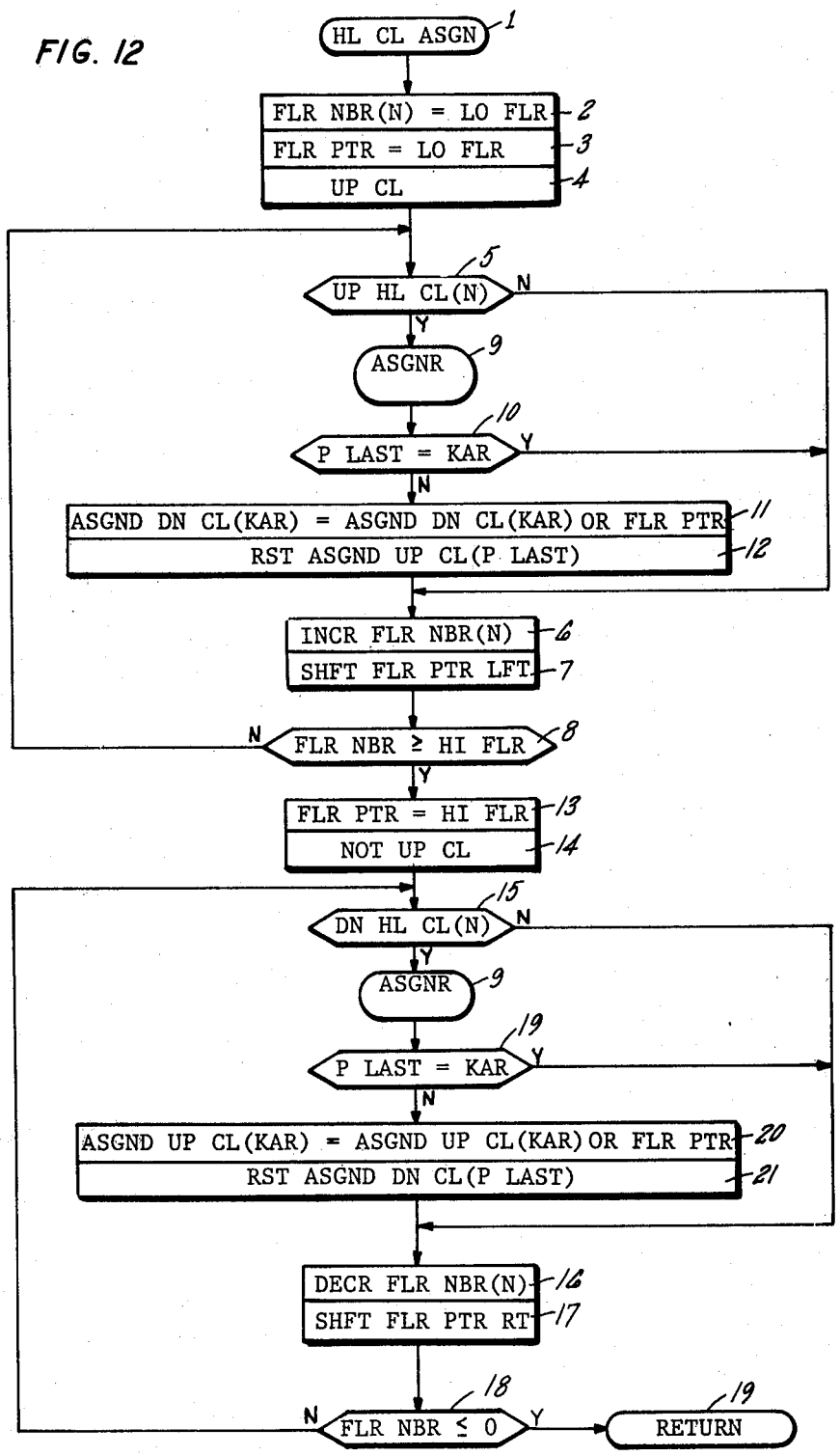
FIG. 12 is a logic flow diagram of a hall call assignment routine.

The hall call assignment routine of FIG. 12 is designed to assign specific calls to cars, in contrast to assigning cars to zones to pick up whichever calls may be there. As described more fully hereinafter, it is contemplated that the hall call assignment routine will be run on the order of five times per second, which means that as each car passes floors at the highest possible speed, calls may be assigned and reassigned four to five times. It also means that, the status of a car which is stopping, stopped, or starting up, including the status of its doors as being open, opening, closed, or closing, can be utilized in updating call allocations on a very rapid basis, for best overall system response.

In FIG. 12, steps 2 and 3 set the lowest floor as the one to be considered by establishing a floor number and floor pointer as the lowest floor. And consideration of up calls is designated by setting an up call flag in step 4. In step 5, the determination of whether there is an up hall call outstanding at floor N is made. If not, the further functions for up calls with respect to this floor are bypassed, a step 6 will increment the floor number and a step 7 will rotate the floor pointer left (to the next higher floor) and a test 8 will determine that the floor number is not yet equal to the highest floor so that the process will be repeated. If there is an up hall call at some floor, when that floor is under consideration, test 5 will be affirmative and will cause the assigner routine of FIGS. 13–18 to be performed. As is described with respect thereto hereinafter, that routine determines the car which should be assigned to the call in view of a variety of system conditions, on a relative basis, for maximizing overall system response considerations. When that subroutine 9 is completed, if the last car to have been assigned to the call (P LAST) is the same as the car which has been assigned the call by the assigner routine in step 9, a test 10 is affirmative, indicating that the call assignment should be left as is. But if the up hall call is assigned for the first time, or reassigned to a different car after having previously been assigned, then test 10 will be negative and a step 11 will cause the up call to be assigned to the car determined best for it by the assigner routine 9, by having the map of assigned up calls for the car designated by the assigner program (KAR) ORed with the floor pointer which indicates the floor number under consideration and therefore the floor at which the assigned up call has been made. In step 12, any previous assignment is eliminated by resetting the assigned up call for the car which previously had it (P LAST). And then the next floor is considered in turn. When all of the floors have been considered, test 8 will be affirmative, and step 13 will ensure that the floor pointer is set to the highest floor of the building. Then the up call flag is reset so as to designate the case of considering down hall calls in step 14. Starting at the highest floor, test 15 will determine if there is a down call for the highest floor. If not, the remaining functions for that floor are bypassed by a negative result of test 15, so that steps 16 and 17 will cause the next lower floor to be considered until such time as a test 18 indicates that the lowest floor has been considered. For any floor in which there is a down hall call registered, test 15 will be affirmative and cause the assigner routine 9 to be performed as is described hereinafter. And a test 19 determines if a new or changed assignment has been made. If it has, test 19 is negative so that the call is assigned to the car designated by the assigner routine (KAR) in step 20, and step 21 causes it to be removed from any car to which it may have previously been assigned. When all of the floors have had their up hall calls and down hall calls considered, test 18 is affirmative and the program will continue with the hall stop command routine described with respect to FIG. 19, through a transfer point 19.

Figure 13:
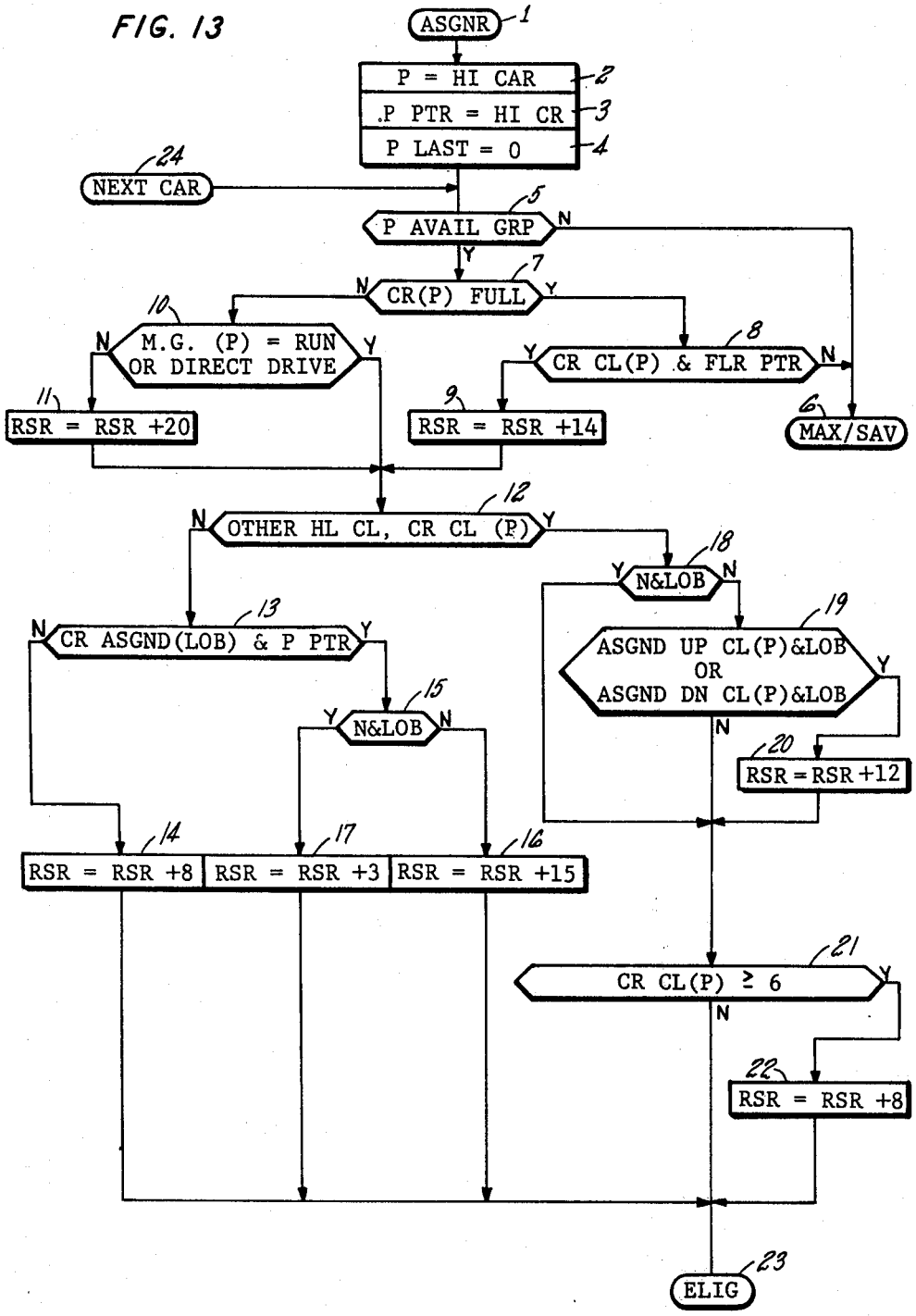
FIGS. 13–18 are a logic flow diagram of an assigner subroutine which may be employed in the hall call assignment routine of FIG. 12.

The assigner routine utilized in the hall call assignment routine of FIG. 12 is entered through an entry point 1 in FIG. 13. Steps 2 and 3 establish a car number and car pointer to indicate the highest numbered car in the building, and a step 4 resets an indication of the last car to have a given call (P LAST) to zero. Then a test 5 determines if the car under consideration is amongst those in the map of cars available to satisfy demand in the group and if the car is not available, most of the considerations with respect to this car are bypassed by reaching a transfer point 6 which just calls into play wrapping up operations, as are described with respect to FIG. M11, hereinafter. But if the car is available to satisfy demand in the group, a test 7 determines if the car is full (from the map of cars determined to be fully loaded, as derived by communications from all of the cars being combined into a single map within the group controller. A negative result from test 7 could be achieved by ANDing the P pointer with a map of cars fully loaded. If the car under consideration is fully loaded, test 7 is affirmative and test 8 determines whether or not there is a car call (one established by the passenger within the car under consideration) for the floor currently under consideration. If not, then the fact that the car is full and won't stop at the floor landing corresponding to the floor call under consideration causes this car to be effectively eliminated for consideration in assigning the present call by means of the transfer point 6. But if this car will stop at the floor where the call being considered has been registered, then test 8 will be affirmative and a relative system response number will have a value added to it indicative of the fact that this car is not highly favored for the car call under consideration, but may in fact be the best car, in dependence upon other factors. Thus, step 9 will add a value such as 14 to the relative system response for this particular car with respect to the car call under consideration in the present performance of the assigner routine.

In FIG. 13, if test 7 had been negative indicating that the car is not full, then a test 10 will determine whether the motor generator set (such as the well known Ward Leonard System) for the car under consideration is running or not, as is indicated in a map of running motor generator sets established in the group controller based upon the conditions with respect to each car having been communicated to the group controller during normal group/car communications. If a particular elevator car is fitted with a solid state direct drive system, not having a motor generator set, then the bit respecting that car in the map of running motor generator sets may be continuously maintained as a one. If a car has a motor generator set which is not running, test 10 will be negative and the relative system response factor will have 20 added to it, providing a disfavorable relative factor with respect to cars which would require starting their motor generator sets before answering this particular call. This will save considerable energy, and is included in the factor even if the car with its motor generator stopped could be started up and answer the call more quickly (indeed even though the car may be physically located at the same landing). Thus, an energy saving is effected by the test 10. Notice that the tests 10 and 8 are alternative since a running car cannot have a stopped motor generator set and since a car with its motor generator set stopped cannot be full.

In FIG. 13, a test 12 determines if the masks of hall calls and car calls for car P have any ONEs in them at all. If they do, that indicates that the car has further demand and will be moving about the building in order to satisfy the tasks which it already has. On the other hand, if test 12 is negative, this indicates a car that might be able to go to rest, thus saving energy if other cars can do the work of answering the hall call under consideration, while they are doing other work which requires them to be running. Therefore, if the car in consideration has no other calls, a test 13 will determine whether the the car is assigned to the lobby floor. If not, a penalty of about 8 is added to the relative system response factor for this car with respect to this call. But if the car is assigned to the lobby floor, then a test 15 will determine if the call under consideration is the lobby floor. If not, a step 16 assigns a relatively high penalty of 15 seconds by adding that to the relative system response factor, because the lobby floor is to be favored and the call under consideration could likely be handled by cars two or three floors away from the lobby; if they can do so within 15 seconds of this car being able to do so then this car will not pick up the call; but only if all the other factors indicate that this car might reach the call only 15 seconds after some other car, then this car will be disfavored for answering that call by that amount. On the other hand, if test 15 indicates that the current call being considered for assignment is at the lobby, then only a small penalty, of about 3 seconds, is indicated for this car, relating to the fact that if there is already another car at the lobby, it is preferred to leave this car assigned to the lobby, rather than confusing passengers by switching car lanterns.

In FIG. 13, if test 12 determines that this car does have other car calls or hall calls, a test 18 determines whether the hall call currently being assigned is at the lobby. If it is not, test 18 is negative and a test 19 determines whether this car already had a lobby call. If it does, the lobby call is to be given favoritism because most traffic in a building passes through the lobby and the greatest demand is at the lobby so that there is a penalty of about 12 seconds applied to this car with respect to this call in a step 20. But if the calls already assigned to this car do not include a lobby call, there is no penalty assigned; and similarly, if test 18 indicates that the lobby floor is under consideration, no additional penalty is provided. Then a test 21 determines if this car has more than six car calls registered within it. If it does, this is an indication that the car is rather busy and has a number of stops to make. In addition to the fact that it will take more time to reach the car in question, it is also true that the likelihood of the conditions for this car remaining constant and therefore being a viable car for assignment are liable to change. And, the time in which the call is serviced, not only the time when the call will be answered, but the time when the passenger who made the call will be delivered to a final destination, is bound to be longer in a car which already has a larger number of assigned calls than otherwise. Therefore, if test 21 is affirmative, a moderate penalty of about 8 seconds is added to the relative system response for this car in a step 22. But if the car has less than six calls, it is known to be a running car which has to be in service anyway and is therefore not disfavored insofar as answering of this call is concerned. When all of the factors of FIG. 13 have been completed with respect to this car, the assigner program continues by transfer point 23 in FIG. 13 and entry point 1 in FIG. 14 to a portion of the program which determines the eligibility of the car for the call in question.

Figure 14:
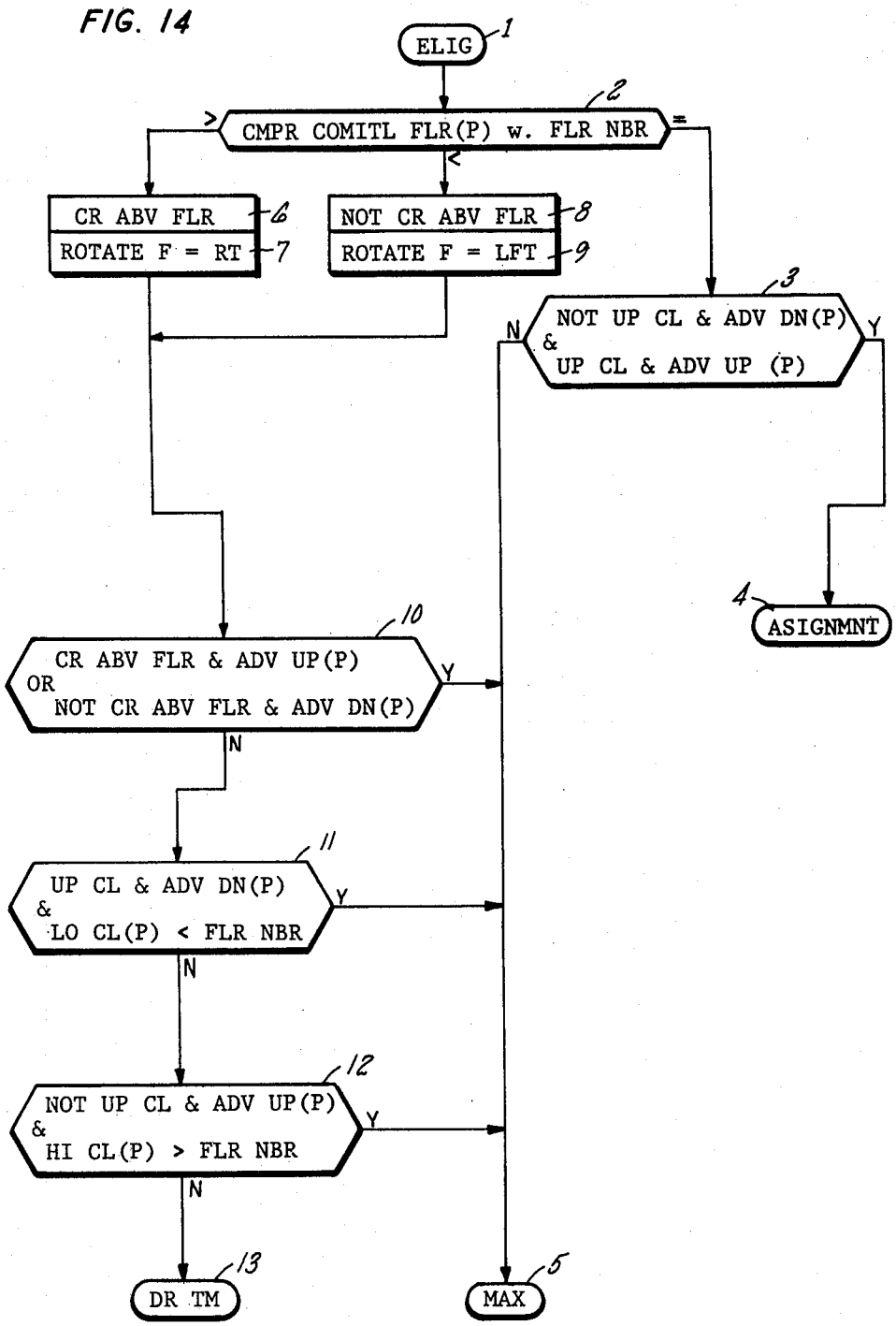

In FIG. 14, a test 2 compares the committable floor of the car under question with the floor number of the hall call under question. If the car has a committable position equal to the floor number, then it will either be a rather favored car (since it is at the desired floor) if it is running in the same direction as the direction of the hall call under consideration, or it will be an essentially impossible car if it is going in the opposite direction from the direction of the hall call. Thus, a test 3 determines if the call under consideration is a down call (not up call) and the car is advancing downwardly, or if the car is an up call and the car is advancing upwardly. If so, test 3 is affirmative and a transfer point 4 will cause the program to branch to the assignment portion thereof described with respect to FIG. 17 hereinafter. But if the directions are opposite, test 3 will be negative and the car is given a maximum relative system response factor by passing through the branch point 5 to a part of the program where a maximum relative system response is assigned, as described with respect to FIG. 17 hereinafter.

In FIG. 14, if the comparison of test 2 indicates that the committable position of the car in question is above the floor of the call being assigned, then a car above floor flag is set in a step 6 and a rotation flag for an F pointer (which identifies floors in a small subroutine described with respect to FIG. 16 hereinafter) is set to rotate the pointer to the right, from higher floors to lower floors; but if test 2 indicates that the committable position of the car under consideration is less than the floor number of the call under consideration, then a step 8 resets the car above floor flag and a step 9 establishes that F pointer rotation should be to the left, or higher floors, as is described more fully hereinafter with respect to FIG. 16. In FIG. 14, a test 10 determines if the car is above the floor and going upwardly, or below the floor and advancing downwardly, in either case indicating that the car is going away from the call. In test 11, if the car is going down, and it has a low call below the hall call under consideration, and an up call must be responded to, the car cannot stop and change direction to handle the up call; it is therefore considered as going down beyond an up call. In test 12, the opposite case from that of test 11 is determined. A down call cannot be answered by a car traveling upward to a call higher than the floor number of the call being assigned and is therefore going up beyond a down call. Affirmative results of tests 10–12 will cause the program to transfer to a point where a maximum response factor penalty is indicated for this car with respect to the call under consideration, through branch point 5. Otherwise, the program transfers to a portion thereof which determines factors relating to the time for servicing existing calls in dependence upon conditions of the car, through a transfer point 13.

Figure 15:
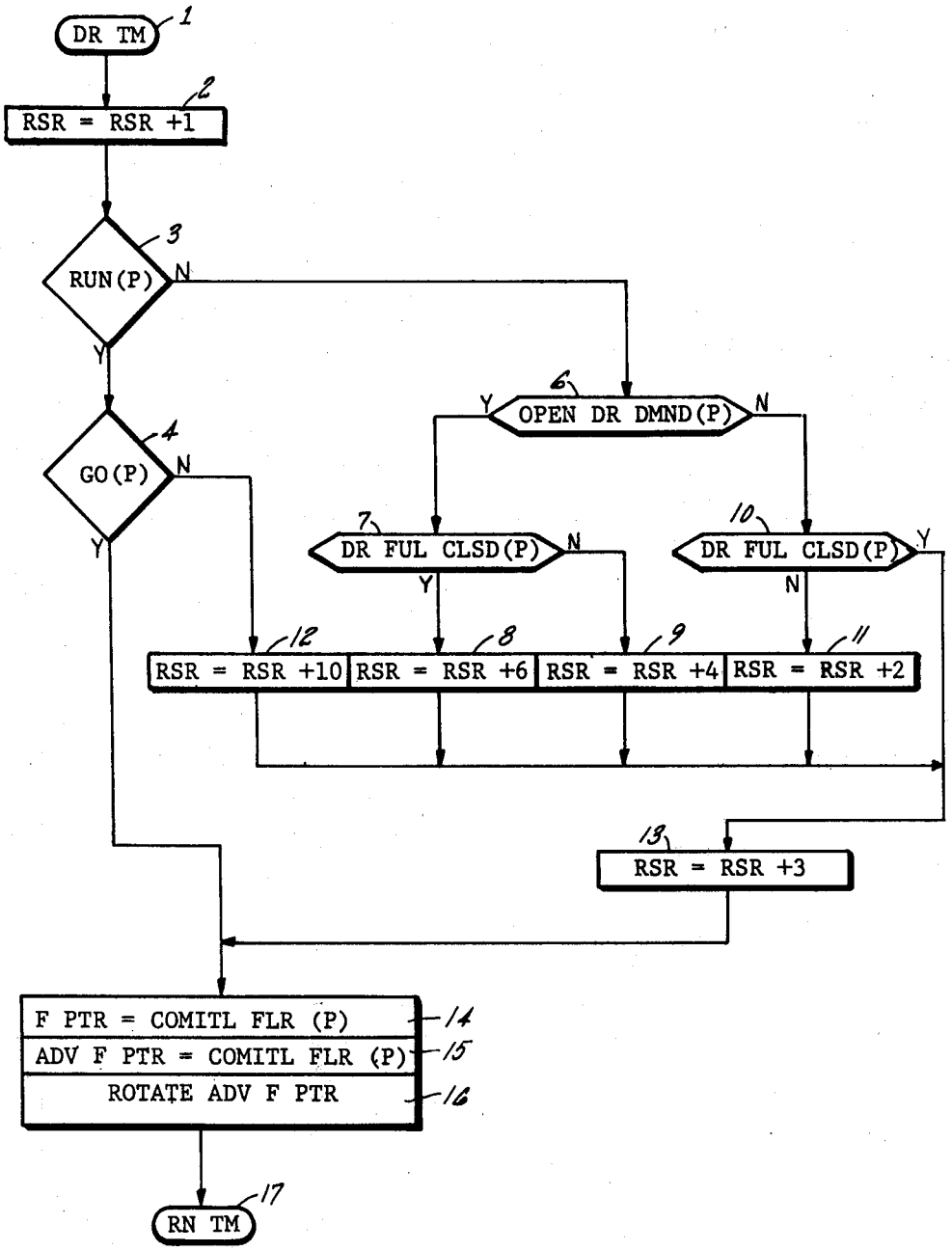

In FIG. 15, consideration of time to operate the doors and the like at landings is given in a portion of the routine reached through an entry point 1. In a step 2, the relative system response factor is incremented by one, since any car which could have reached this part of the program in its consideration, must at least pass one floor at high speed, which may take on the order of 1 second. As described elsewhere herein, of course, if the speeds indicate higher or lower elapsed time for a high speed pass of a floor, or if other parameters or values are assigned, then this may be set to a different value in accordance with the particular manner in which the invention is implemented.

In FIG. 15, a test 3 determines if the car in question is running. If it is, a test 4 determines if it is going to remain running by virtue of its go signal still being indicated to the group controller. If the car is running and will remain running, consideration of door condition can be bypassed. But if step 3 is negative, indicating that the car is not running, then the car is stopped. And a test 6 determines if the door is commanded to be open. If so, a test 7 determines if the door is still fully closed; if it is fully closed, then a time of 6 seconds is added since a full door opening will be required. But if the door is not fully closed as indicated in test 7 but has been commanded to open as indicated in test 6, then the door is necessarily opening and a smaller time of about 4 seconds is added in a step 9.

If step 6 in FIG. 15 is negative, meaning the door is not under a command to open, then a test 10 will determine if the door is fully closed. If it is, there is no time required with respect to the door; but if it is not yet fully closed, then a very small time of about 2 seconds is provided to the relative system response for this car with respect to this call, in a step 11.

If test 3 in FIG. 15 is affirmative meaning that the car is running, but if it no longer has a go signal indicating that the car is stopping, test 4 will be negative and a complete stop time of 10 seconds is provided in step 12 since the stopping, opening, and closing of the doors, and the door open time will be on the order of 10 seconds for this car, before it can proceed toward answering any further calls. If either test 3 or test 4 indicates that the car in question must make or finish a floor landing stop before it could proceed toward answering the call under consideration, the relative system response factor is increased by about 3 seconds in a step 13 to accommodate the slower speed of the car as it slows down to a stop and as it accelerates from a stop in contrast with the roughly 1 second required for a maximum speed bypass of a floor where no stop is considered.

In FIG. 15, when door considerations are completed, initial steps required in order to estimate run time of the given car to the hall call in question are made. In a step 14, a special limited use floor pointer, called an F pointer, is set to the committable floor of the car under consideration, and a second special floor pointer, which is ultimately advanced to be one floor ahead of the F pointer, referred to herein as an advance F pointer, is also set to the committable floor position in a step 15. The advance F pointer is rotated in step 16 in the direction indicated by the rotate F factor established in either steps 7 or 9 as described with respect to FIG. 14 hereinbefore. Thus, whether the F pointer is to have lower or higher floors, the advance pointer will get one step ahead of it at this point. And then the program advances through a transfer point 17 to the run time calculations which are entered through an entry point 1 in FIG. 16.

Figure 16:
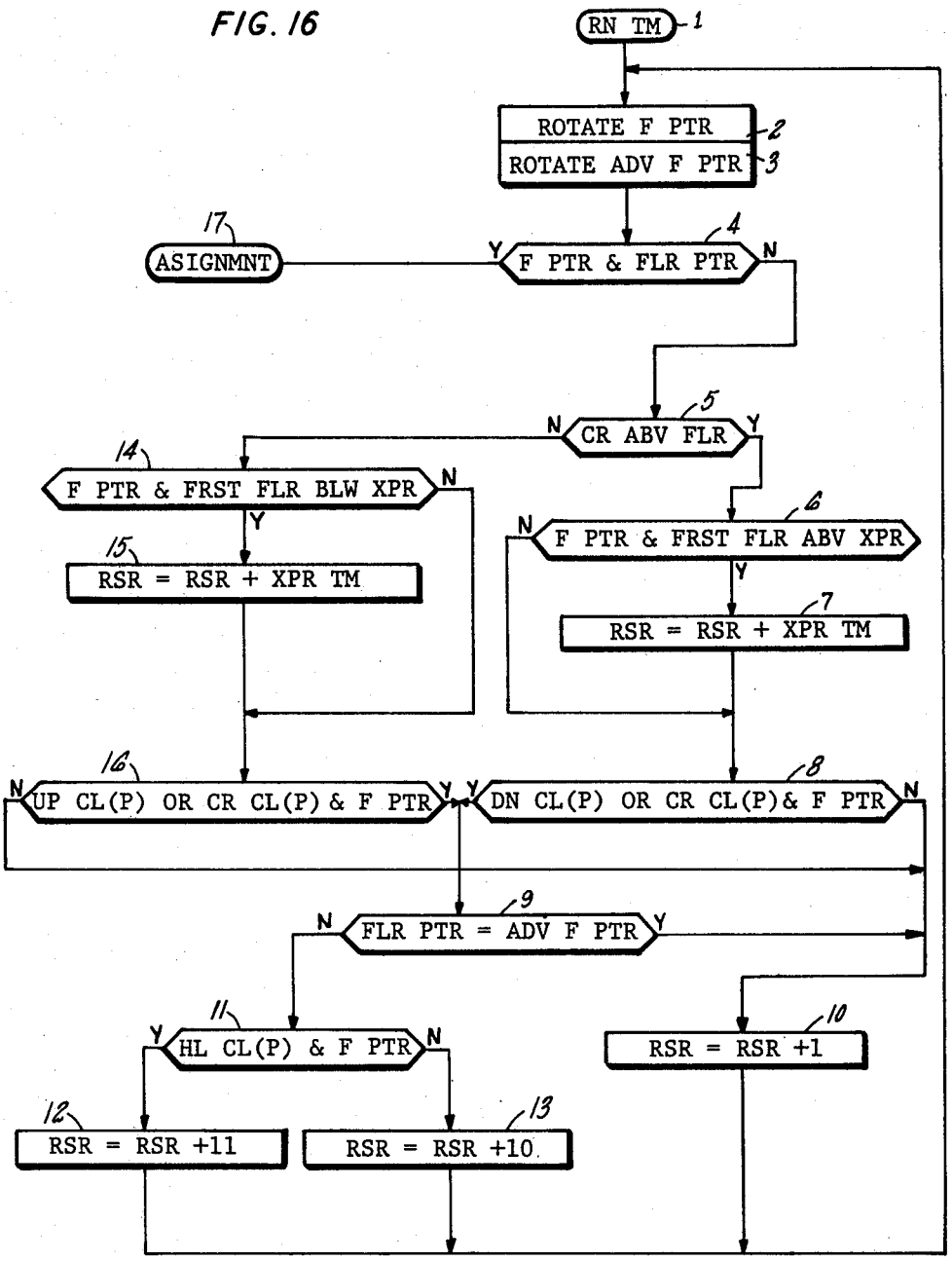

In FIG. 16, steps 2 and 3 rotate both the F pointer and the advance F pointer so as to indicate a lower floor in the case where the car is above the floor of the call under consideration, so that the expected run time of the car as it proceeds from its present committable position downwardly to the floor of the hall call under consideration can be estimated. Or if the car is below the floor of the hall call under consideration, the pointers will be rotated for increasing floors so as to scan from the present committable floor of the car upwardly to the hall call under consideration.

In FIG. 16, a test 4 determines if all the floors between the present position of the car and the floor of the hall call under consideration have been scanned or not. If they have, the program advances as is described hereinafter. For each floor between the present committable position of the car and the floor of the hall call being considered, a test 5 determines if the car has previously been determined to be above or below the floor by testing the car above floor flag. If the car is above the floor, then a test 6 is made to determine if the floor being scanned in this portion of the subroutine is the first floor above an express zone. If it is, test 6 is affirmative and a step 7 will add to the response factor, the time which it takes to run high speed through an express zone, such as 1 second for each of the floors in an express zone. This is a number which is pre-established with respect to any given installation and simply is looked up in a suitable test. Then, a test 8 determines if the car which is above the floor of the call in consideration, and therefore can answer only down calls and car calls, has any such calls registered for it at the floor currently being scanned. If it does, a test 9 determines, by means of the advance F pointer, whether the floor whose call is under consideration is one floor ahead of the floor being scanned. If so, an affirmative result from test 9 indicates that the car being considered for a particular floor call has an assigned call at a floor adjacent to the floor under consideration, which it will reach before it reaches the floor under consideration. In such case, a step 10 will assign a time of only 1 second to account for only the high speed run time past this floor; the remaining time for stopping and servicing passengers (10 seconds) being ignored, thereby favoring assignment of the contiguous hall call to this car. If, on the other hand, test 9 is negative, then a test 11 is performed to determine whether a hall call is involved (whether a car call was involved or not in test 8). If a hall call is involved, then a step 12 adds a time of about 11 seconds to this car with respect to this call, which represents 7 seconds necessary to open and close the doors and service the call, and 4 seconds increased running time due to the need to decelerate and reaccelerate the car. But if test 11 determines that the involved call of test 8 is not a hall call, then it is a car call and a step 13 provides a time of 10 seconds, since a car call takes about 1 second less than a hall call to service (due to the fact that the passenger getting off the elevator is waiting for the door to open in contrast with a passenger in a hallway who may have to find the serving elevator and walk toward it).

In a similar fashion, if the car is not above the floor as determined in test 5, a test 14 determines if the floor being considered for calls between the car involved and the hall call being assigned is the first floor below an express zone. If it is, then the relative system response factor has added to it the time necessary to run the express zone, which may be on the order of 1 second per floor, in a step 15. Then a test 16 determines whether there is an up call or a car call at the floor under consideration, and if there is, the contiguous call test 9 is made as described hereinbefore. And if that is successful, or if there are no calls at the floor under consideration, then a time of about 1 second is assigned, as is described with respect to down calls, hereinbefore. Similarly, if test 9 is negative, then either 10 or 11 seconds will be added in the case of car calls or hall calls, in step 12 or 13, respectively. When each floor, represented by the F pointer and the advance F pointer, has been given consideration with respect to each car, test 4 will be affirmative, and the program will continue in the assignment portion thereof by means of a transfer point 17.

Figure 17:
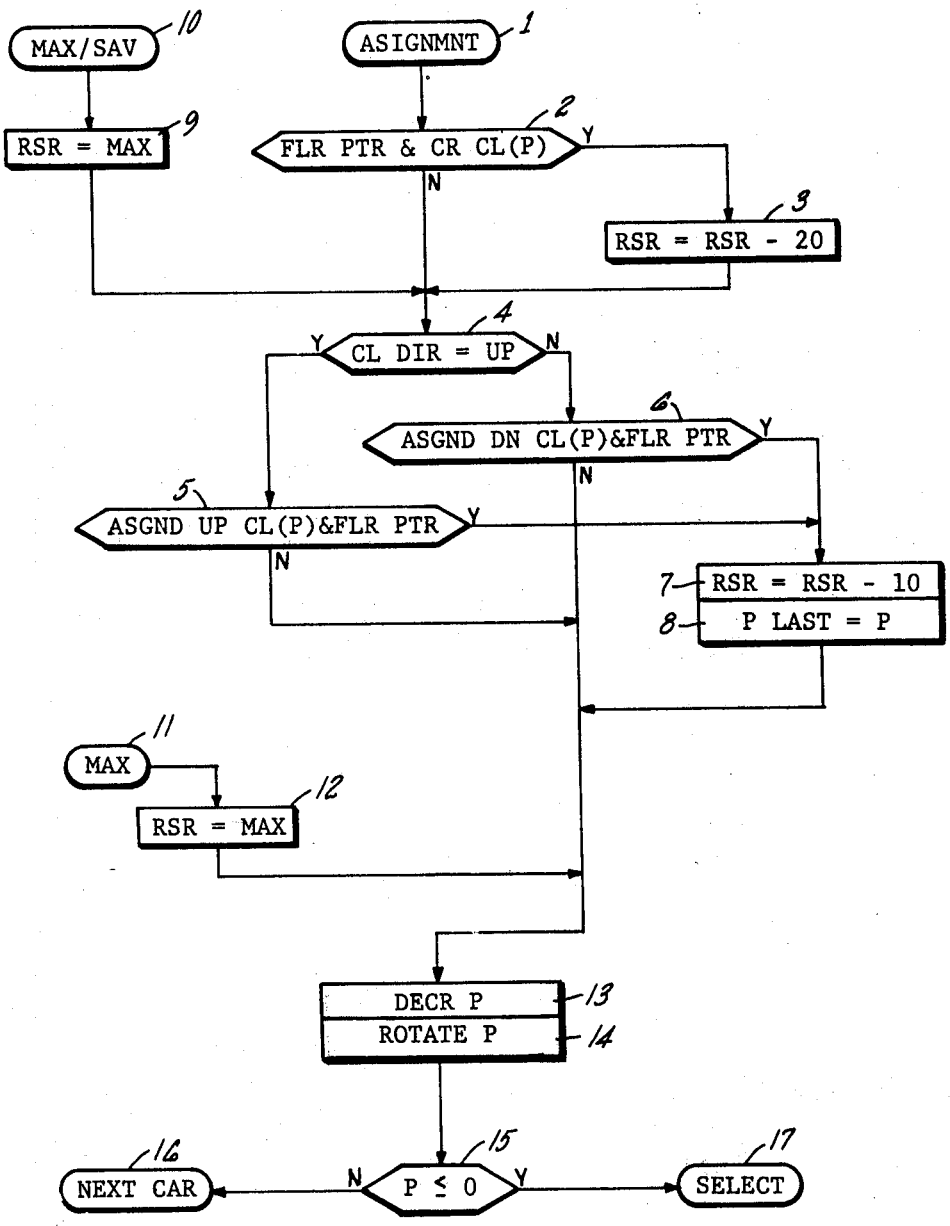

After conclusion of calculation of the run times in FIG. 16, the program continues in FIG. 17 through the assignment transfer point 1, and a test 2 determines if there is a car call coincident with the floor call under consideration, which, if there is, must be of a car traveling in the same direction (up or down) as the hall call being considered, because any car not traveling in the right direction cannot possibly have any calls that will coincide, due to the fact that all car calls are ahead of the car, and any car which is not approaching the hall call under consideration from the right direction will be eliminated in the eligibility portion of the program as described with respect to FIG. 14 hereinbefore. If test 2 is affirmative, this is a very favorable situation since the car must stop at that floor anyway, so this car is favored by a step 3 which subtracts about 20 seconds from the relative system response factor for this car in consideration of the hall call being assigned. Then, a test 4 determines if the call direction is up. If so, the assigned up calls for the car P, which is a map of ones indicating every up call which has been assigned to car P, is compared with the floor pointer to see if there is an assigned up call for this car at the floor under consideration. Similarly, if test 4 is negative, a test 6 makes the same consideration with respect to down calls. If either test 5 or 6 is affirmative, depending on the direction of the call under question, this means that this car has previously had this particular call assigned to it, having been so assigned in a previous pass through the hall call assignment routine. In such case, this car is favored to retain the call by a step 7 which subtracts about 10 seconds from the relative system response which has been accumulated for the car with respect to the call. And, to keep track of the fact that this car previously had this call, P LAST is set equal to P in a step 8, for use as is described hereinbefore with respect to FIG. 12.

In FIG. 17, under certain considerations of a car not being able to handle the call under consideration, the relative system response factor for that car may be set to a maximum value (such as 256 seconds) by a step 9 (top of FIG. 17) which is reached through a MAX/SAVE transfer point 10 (which is the same as the transfer point 6 in FIG. 13). In such cases, the car has either become unavailable to the group or has become full; since it could possibly have previously had the call in question, the functions described with respect to test 4 through step 8 are performed with respect to such car, even though it is extremely unlikely that such car could retain the assignment of this call.

In FIG. 17, a transfer point 11 which causes a step 12 to set the relative system response for the car under question to the maximum value may be reached through a transfer point 5 in FIG. 14, which means that the car is not eligible to handle the call under question. And since such cars couldn't possibly have had this call assigned to them in a previous pass, the functions of test 4 through step 8 need not be performed with respect thereto.

At this point in the program, the relative system response for the particular car under consideration has been fully accumulated. Then, steps 13 and 14 decrement the P number and rotate the P pointer so as to identify the next lowest numbered car in the building for consideration of its relative system response factor. A test 15 determines if the lowest car has been considered, and if not, the assigner routine, beginning on FIG. 13, is reached through a transfer point 16 on FIG. 17 and a transfer point 24 on FIG. 13 so that the next subsequent car will have a relative system response factor assigned to it with respect to the particular call under consideration. When all the cars have been given consideration with respect to the particular call in question, the program continues by transfer point 17 on FIG. 17 and entry point 1 on FIG. 18 to the select portion of the assigner routine.

Figure 18:
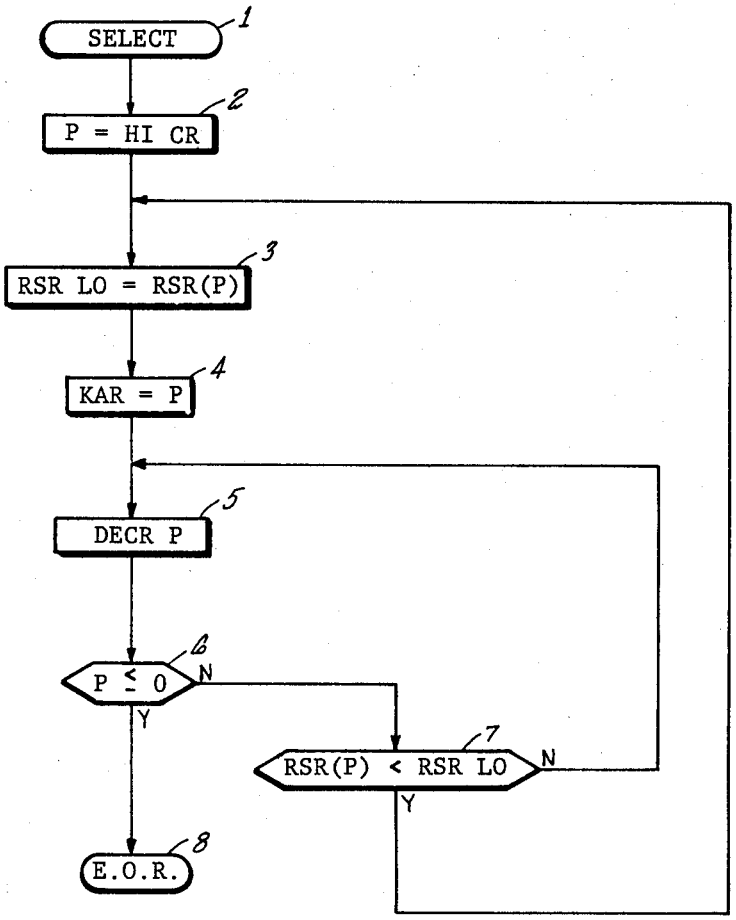

In FIG. 18, the P number is no longer being used for keeping track of cars that had their relative system responses calculated, and is set in step 2 to be equal to the high car. All of the cars will now be scanned to see which one has the lowest relative system response factor and thereby have the call assigned to it. In a step 3 the relative system response low buffer is set to equal the relative system response of car P. A KAR buffer is set equal to the car number of car P; this identifies the car whose relative system response has last been established in the relative system response low buffer in step 3. Then in a step 5 the P number is decremented and if a test 6 determines that the lowest numbered car in the building has not yet been considered, a test 7 compares the relative system response of the presently considered car (P) to see if it is less than that which has previously been stored in a relative system response low buffer by step 3. If test 7 is affirmative, the relative system response low buffer will be updated to a new, lower amount corresponding to the car P, in step 3. If not, this car is ignored and the P number is decremented in step 5. When step 6 is finally affirmative, all the cars will have been polled, the lowest relative system response for any of the cars will be set in the relative system response low buffer, and the identity of the car having such lowest response will be set in the KAR buffer 4. And then, the assigner routine ends through an end of routine point 8, which causes the program to continue with the hall call assignment routine, described hereinbefore with respect to FIG. 12, specifically picking up at either test 10 or test 19 to determine whether the car to which the call has just been assigned (KAR) is equal to the car which previously had the call (P LAST).

Figure 19:
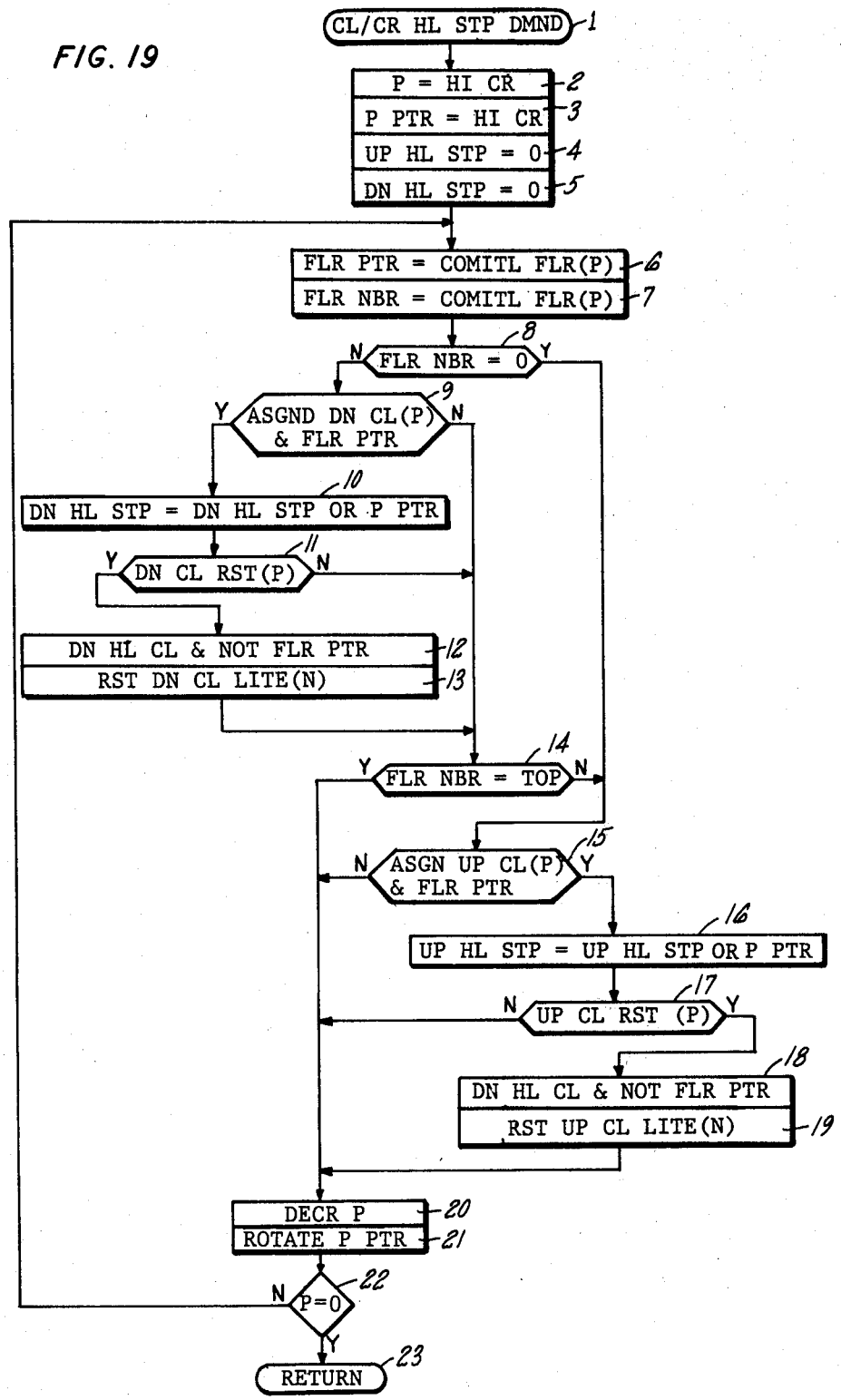
FIG. 19 is a logic flow diagram of a call to car hall stop demand routine.

Conclusion of the hall assignment routine of FIG. 12 will cause the program to advance through the transfer point 19 to the call to car hall stop command routine of FIG. 19.

In FIG. 19, entry through an entry point 1 leads to steps 2 and 3 which establish a P number and P pointer as the highest numbered car in the building, and steps 4 and 5 which cause the up hall stop and down hall stop maps to be set to all zeroes. Then steps 6 and 7 set a floor pointer and floor number to the committable floor of the car (P) under consideration. Then a test 8 determines if the car is at the lowest floor, and if not, a test 9 compares the map of down calls assigned to the car under consideration with the floor under consideration (the committable floor of the car under consideration) and if they are the same, a step 10 updates a map of down hall stops by ORing to itself the P pointer; this provides the map of down hall stops, which is changed in every pass through the routine, with a bit in the position of car P, indicating that car P is one of the cars having a down hall stop during this pass through the routine. Then a test 11 determines if the car in question is issuing a down call reset; if it is, the down hall call map has the bit relating to the floor in question (the committable floor of P) reset by ANDing with the complement of the floor pointer, and the down call light at floor N is turned off, in steps 12 and 13. Then a test 14 determines if the floor in question is the top floor; if not, or if test 8 had determined that the floor number was the lowest floor, then a test 15 determines if this car has an up call at the current floor. If so, an up hall stop is added to the up hall stop map in a step 16. If the car is issuing a reset for an up call as determined in test 17, then the up call is reset and the call light is turned off in steps 18 and 19.

In FIG. 19, completion of steps 13 and/or 19 has made provision for the fact that the car should be commanded to stop for a hall call at its next committable floor, or that it has answered a call at its committable floor which is then reset. Then, the next car in sequence is identified by decrementing the P number and rotating the P pointer in steps 20 and 21 to perform these same functions for the next lower numbered car in the building, if a test 22 indicates that all cars have not yet been considered, and to transfer the program to the cars to calls group demand routine of FIG. 20 through a transfer point 23, after all cars have been considered.

Figure 20:
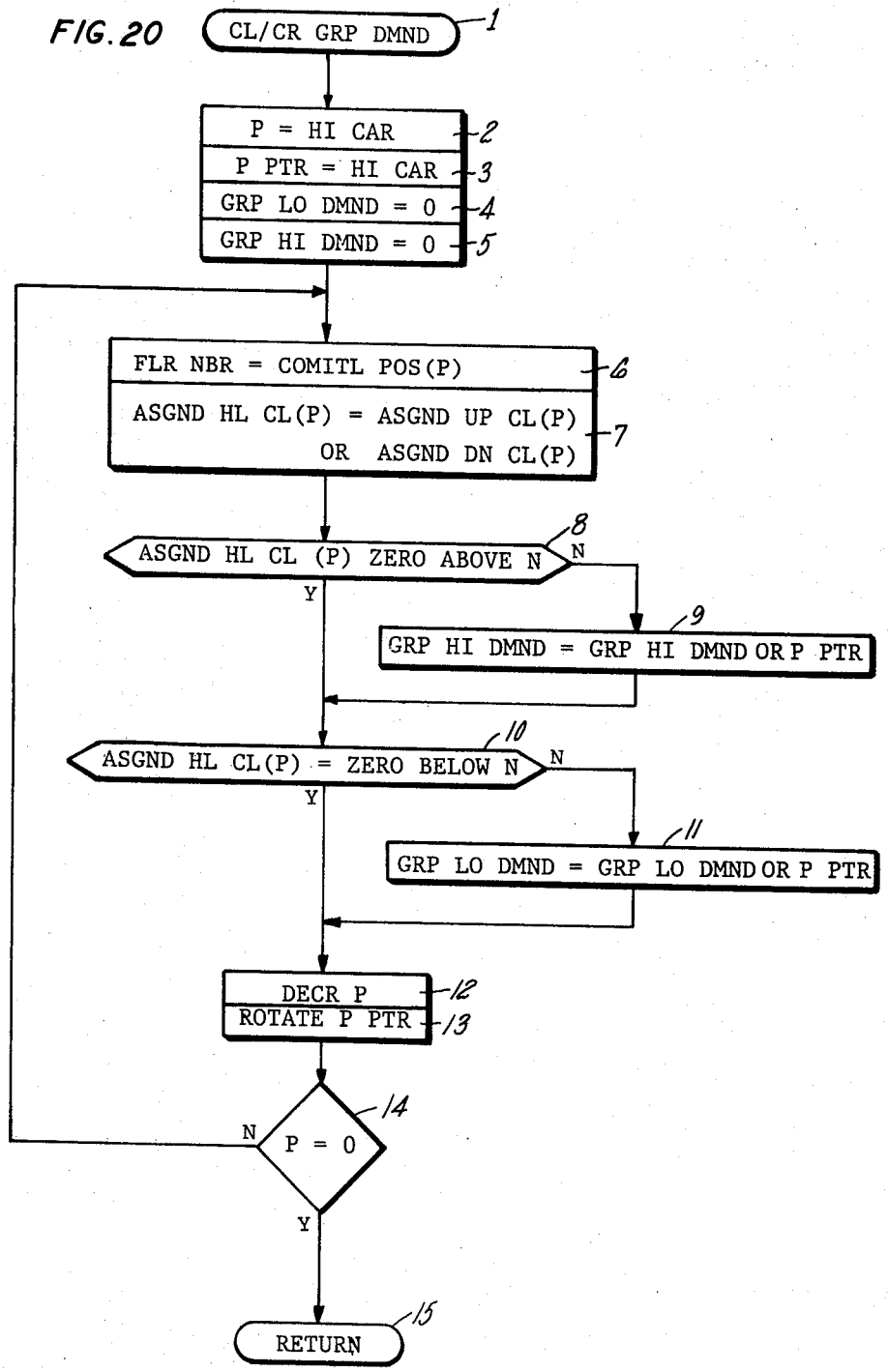
FIG. 20 is a logic flow diagram of a call to car group demand subroutine.

In FIG. 20, the cars to calls group demand routine is entered through an entry point 1 and the highest car in the building is set for consideration by setting a P number and a P pointer to the highest numbered car in the building, in steps 2 and 3. Then a group higher demand map and a group lower demand map are set to zeros in steps 4 and 5. A step 6 sets the floor pointer to the committable floor of the car under consideration and a step 7 prepares a map of assigned hall calls for the car under consideration as being the logical OR of assigned up calls and assigned down calls for the car under consideration.

In FIG. 20, a test 8 examines the map of hall calls for the car under consideration to determine if it is all zeros above the floor number (N). If it is not all zeros, that means there are calls above the committable position of the car and the car should continue to advance upwardly in order to service those calls. Thus, a negative response from test 8 will cause a step 9 to update the map of group higher demands, there being one bit in the map for each car, to include a bit in the bit position for the car under consideration. This is done by ORing the group higher demand map (previously set to zero at the start of this routine) with the P pointer, which identifies the car under consideration. Then a test 10 determines if the map of hall calls assigned to this car (step 7 above) indicates no calls below the committable position. If that is not true, test 10 is negative so a step 11 will create lower demand for the car by updating the group lower demand map to include a bit for the car in question, by ORing that map with the P pointer. Then the next car is established for consideration by decrementing the P number and rotating the P pointer in steps 12 and 13, and if all the cars have not yet been given consideration as determined in a test 14, steps 6 through 13 are repeated. When all cars have been considered, so that the group lower demand map and the group higher demand map includes bits for all cars requiring either higher or lower travel to service their calls, step 14 is affirmative and the overall program of the group controller is returned to through a transfer point 15. As referred to hereinbefore with respect to FIG. 3, this will cause discrete outputs and control of lights at the halls and lobby panel to be accomplished by a suitable routine 22, preparing information to be sent to the cars in a routine 23, and communicating with the cars in a communication routine 24. And then the entire program of FIG. 3 is repeated again.

All of the relative system response factors, whether they be penalties or preferences, or estimated times to operate or run, may be varied widely from those shown herein to provide any scheme of system response deemed suitable in any particular system where the invention is employed.

This invention may be employed in systems which do not use the relative system response factors in assigning calls, such as fastest-response time estimating systems, or other others, known to the prior art.

Similarly, although the invention has been shown and described with respect to exemplary embodiments thereof, it should be understood by those skilled in the art that the foregoing and various other changes, omissions and additions may be made therein and thereto without departing from the spirit and scope of the invention.

I claim:

1. An elevator system including a group of elevators for servicing a plurality of floor landings divided into zones in a building, comprising:

group controller means, including hall call means for registering calls for up and down service at each of said landings and signal processing means for exchanging signals with each of said elevators, responsive to said hall call means and to said signals indicative of conditions of said cars for determining the zone in which each car is located, for assigning cars to zones, and for providing zone control over the cars including determining empty zones, determining the floor of highest and lowest hall calls in each zone, providing zone demand signals to the cars to command the cars to move upward or downward in the building to fill empty zones with unassigned cars and to cause assigned cars to reach floors in their respective zones where hall calls are registered, determining up and down peak traffic conditions, forcing cars from selected zones in the high end of the building to the main landing in response to up peak traffic conditions, forcing cars from selected zones in the low end of the building to the highest floor of the building in response to down peak traffic conditions, and issuing stop commands to each car in response to said signals indicative of conditions of said car indicating that the committable floor position of said car coincides with the floor landing of an empty zone or a hall call for which a zone demand signal has been provided to said car;

each of said elevators including a car, car motion means for providing and arresting the motion of said car, means registering car calls for service required by passengers therein, and a car controller means for providing signals indicative of conditions of said car, for controlling said car motion means to cause said car to move in a selected up or down direction and to stop in response to said signals indicative of conditions of said car and to signals received from said group controller means;

characterized by said signal processing means comprising means for establishing a cars-to-floors mode of operation in response to up peak traffic conditions, or down peak traffic conditions, or the absence of any registered hall calls, for alternatively establishing a calls-to-cars mode of operation in response to the presence of registered hall calls and the absence of up peak and down peak traffic conditions, for providing said zone control over the cars when in said cars-to-calls mode of operation, and operative when in said calls-to-cars mode of operation for assigning any registered hall call to any one of said cars in dependence on the floor and direction of each hall call and conditions of each car, including the location and direction of travel of such car and the service to be performed by such car in advance of being able to service such hall call, and for issuing group hall stop demands to each car in response to said signals indicative of conditions of such car indicating that such car has a committable floor position which coincides with a hall call at a floor assigned to such car.

2. An elevator system according to claim 1 further characterized by said signal processing means comprising means for determining when no car is located at the main landing zone of said building, no car has a car call registered within it for said main landing, and no hall call is registered for said main landing, and in response to such determination, registering a hall call for said main landing, and for establishing said cars-to-floors mode of operation in response to there being no registered hall calls only in concurrence with there being a car assigned to the main landing zone of said building.

* * * * *